US010788228B2

(12) United States Patent
Thomas, Jr. et al.

(10) Patent No.: US 10,788,228 B2
(45) Date of Patent: Sep. 29, 2020

(54) ENHANCED TECHNIQUES FOR AIR CURTAIN CONTROL

(71) Applicant: Berner International Corporation, New Castle, PA (US)

(72) Inventors: Philip M. Thomas, Jr., Cranberry Township, PA (US); Lih Wei Chia, Singapore (SG); Yan Yi Seow, Singapore (SG); Yee Hui Poh, Singapore (SG)

(73) Assignee: Berner International Corporation, New Castle, PA (US)

( * ) Notice: Subject to any disclaimer, the term of this patent is extended or adjusted under 35 U.S.C. 154(b) by 187 days.

(21) Appl. No.: 14/794,034

(22) Filed: Jul. 8, 2015

(65) Prior Publication Data

US 2017/0227244 A1 Aug. 10, 2017

(51) Int. Cl.
*F24F 11/30* (2018.01)
*F24F 11/62* (2018.01)
(Continued)

(52) U.S. Cl.
CPC ..... *F24F 11/30* (2018.01); *F24F 9/00* (2013.01); *F24F 11/62* (2018.01);
(Continued)

(58) Field of Classification Search
CPC ..... F24F 11/006; F24F 11/001; F24F 9/00; F24F 2011/0042; F24F 2011/0013;
(Continued)

(56) References Cited

U.S. PATENT DOCUMENTS 3,068,775 A * 12/1962 Zehnder ..... F24F 9/00 454/192
5,010,739 A * 4/1991 Isshiki ..... F04D 27/004 181/175

(Continued)

FOREIGN PATENT DOCUMENTS

WO WO 2005085718 A1 * 9/2005 ..... F24F 9/00

*Primary Examiner* — Thomas C Lee
*Assistant Examiner* — Anzuman Sharmin
(74) *Attorney, Agent, or Firm* — Michael D. Lazzara; Leech Tishman Fuscaldo & Lampl

(57) ABSTRACT

Tools, strategies, and techniques are provided for enhancing the control and operation of air curtain devices. The air curtain device can be provided with a computer system programmed to receive input data from various sensors and to communicate the sensor data to a wireless mesh computer architecture. An algorithm module can be programmed to determine adjusted settings or parameters for the air curtain device in response to the sensor data and/or other data sources such as external data sources. Data may be obtained from multiple air curtain devices configured for cooperative performance, and operating parameters or settings may be adjusted in connection with one or more of the multiple air curtain devices. A control device of the air curtain may be provided with a unitary structure suitable for efficient installation of multiple control harness connectors thereon to supply power and/or to establish data connectivity with multiple components of the control device.

14 Claims, 31 Drawing Sheets

(51) Int. Cl.

| | |
|---|---|
| ***F24F 9/00*** | (2006.01) |
| ***H01R 12/70*** | (2011.01) |
| ***F24F 110/32*** | (2018.01) |
| ***F24F 110/00*** | (2018.01) |

(52) U.S. Cl.
CPC ..... *H01R 12/7088* (2013.01); *F24F 2110/00* (2018.01); *F24F 2110/32* (2018.01)

(58) Field of Classification Search
CPC ..... F24F 11/0079; F24F 11/0078; F24F 2011/0056; F24F 2011/0039; F24F 2011/0063; F24F 2011/0061; F24F 2011/0016
See application file for complete search history.

(56) References Cited

U.S. PATENT DOCUMENTS 5,878,529 A * 3/1999 Huber ..... E06B 3/90 109/8
5,924,486 A * 7/1999 Ehlers ..... G05D 23/1923 165/238
6,375,562 B1 * 4/2002 Hein ..... E06B 3/903 454/188
8,376,822 B1 * 2/2013 Smith ..... A61N 7/02 454/188
2007/0119958 A1 * 5/2007 Kates ..... G05D 23/1934 236/1 B
2009/0123284 A1 * 5/2009 Madsen ..... F04D 25/088 416/36
2012/0065783 A1 * 3/2012 Fadell ..... G05D 23/1917 700/276
2013/0114582 A1 * 5/2013 Husney ..... H04W 4/006 370/338
2013/0134962 A1 * 5/2013 Kamel ..... G06Q 50/06 324/103 R
2015/0075766 A1 * 3/2015 Alston ..... F25B 49/02 165/287
2015/0369505 A1 * 12/2015 Malve ..... H04W 4/008 700/276

* cited by examiner

Smart Controller Wireless Interconnect Design
(Independent)

ENHANCED TECHNIQUES FOR AIR CURTAIN CONTROL

BACKGROUND

Promoting desired conditions within an environment such as a building, factory, warehouse, or other type of facility can be important to the beneficial use and enjoyment of the facility. The environmental conditions within a facility can be impacted by multiple factors, including ambient weather conditions surrounding the exterior of the facility, the number of entrances or exits providing access to the facility, and the volume and frequency of traffic entering and leaving the facility, including people and vehicles. For many facilities, an air curtain can provide an effective way to mitigate the effect of these factors and to maintain steady state environmental conditions within the facility. Air curtain devices offer air supply and air conditioning components which can generate a controlled stream of air to separate two distinct environments in a variety of operational venues or facilities.

With reference to FIGS. 1A and 1B, in one example of the operation of an air curtain device 102, an air curtain 104 (conceptualized as multiple directional arrows in the example shown) can be generated by the device 102 to provide separation between adjacent environments 106, 108 such as the environment comprising the exterior of a facility from the environment comprising the interior of the facility. The air barrier 104 can be directed across an opening 110 such as the door entrance to a store or other facility, for example, for separating the environment outside the store from the interior of the store, or for separating different rooms or other areas within the same facility, among other potential uses.

Improved tools, techniques, and strategies are needed to enhance the ability of an air curtain device to maintain desired environmental conditions and provide effective separation between distinct environments.

BRIEF DESCRIPTION OF THE FIGURES

The discussion contained in the detailed description is associated with the accompanying figures, in which.

DETAILED DESCRIPTION

In various embodiments, the invention offers tools, strategies, and techniques for enhancing the control and operation of air curtain devices. The air curtain device can be provided with a computer system programmed to receive input data from various sensors and to communicate the sensor data to a wireless mesh computer architecture, an Internet cloud-based architecture, or a backend computer sever, among other types of suitable computer devices and architecture. An algorithm module can be programmed to determine adjusted settings or parameters for the air curtain device in response to the sensor data and/or other data sources such as external data sources. The air curtain device may also be configured to communicate with the wireless mesh or the access device of a user (e.g., a smart phone) through a networked communication connection (e.g., a "Wi-Fi" connection) and/or through a device communication connection (e.g., a "Bluetooth" connection). The air curtain device can be programmed for adjustment of its operating parameters or settings through an access device or by communications received from the wireless mesh. In certain embodiments, data may be obtained and processed from multiple air curtain devices configured for cooperative performance, and operating parameters or settings may be adjusted in connection with one or more of the multiple air curtain devices. In this manner, operational performance and cost efficiencies and benefits can be realized by automated adjustment and control of the air curtain device, whether operating as a stand-alone device or in cooperation with other such devices.

Figure 1A:
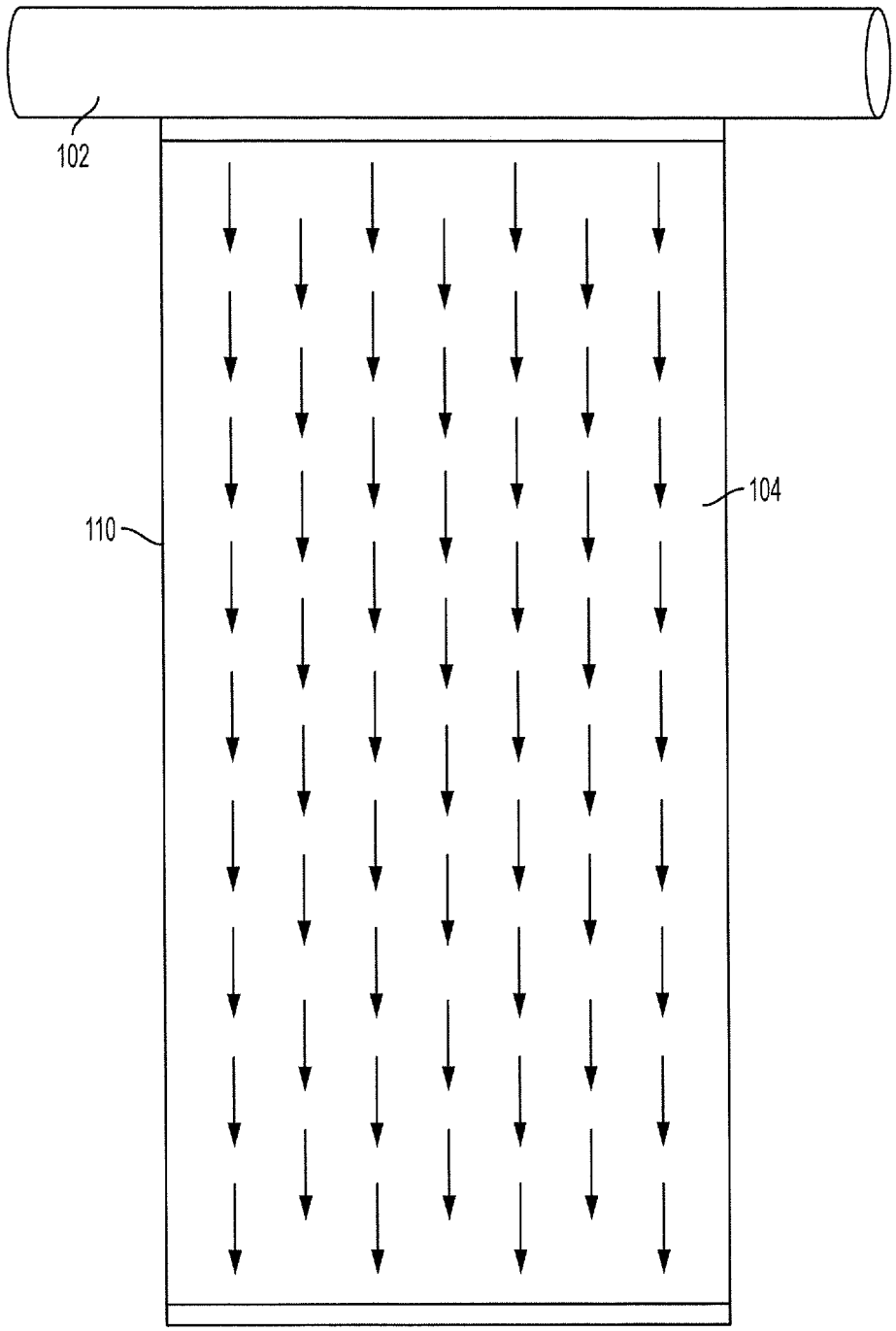
FIG. 1A PRIOR ART
FIGS. 1A and 1B include examples of general air curtain operation as provided in the prior art.
Figure 1B:
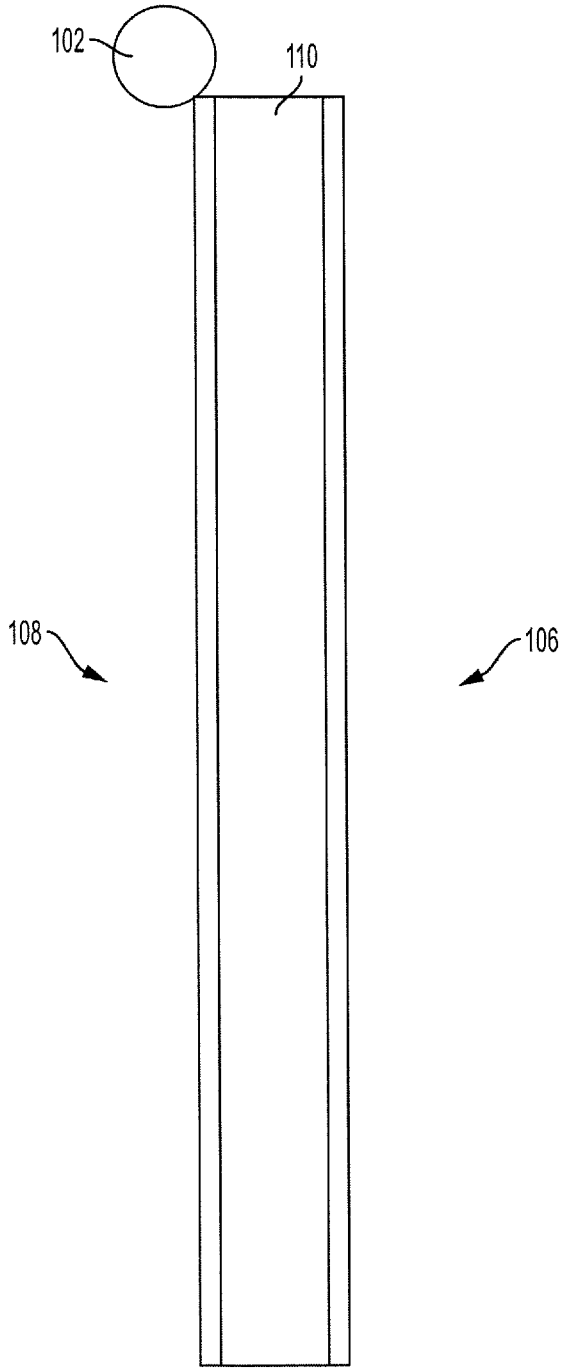
FIG. 1B PRIOR ART
Figure 2:
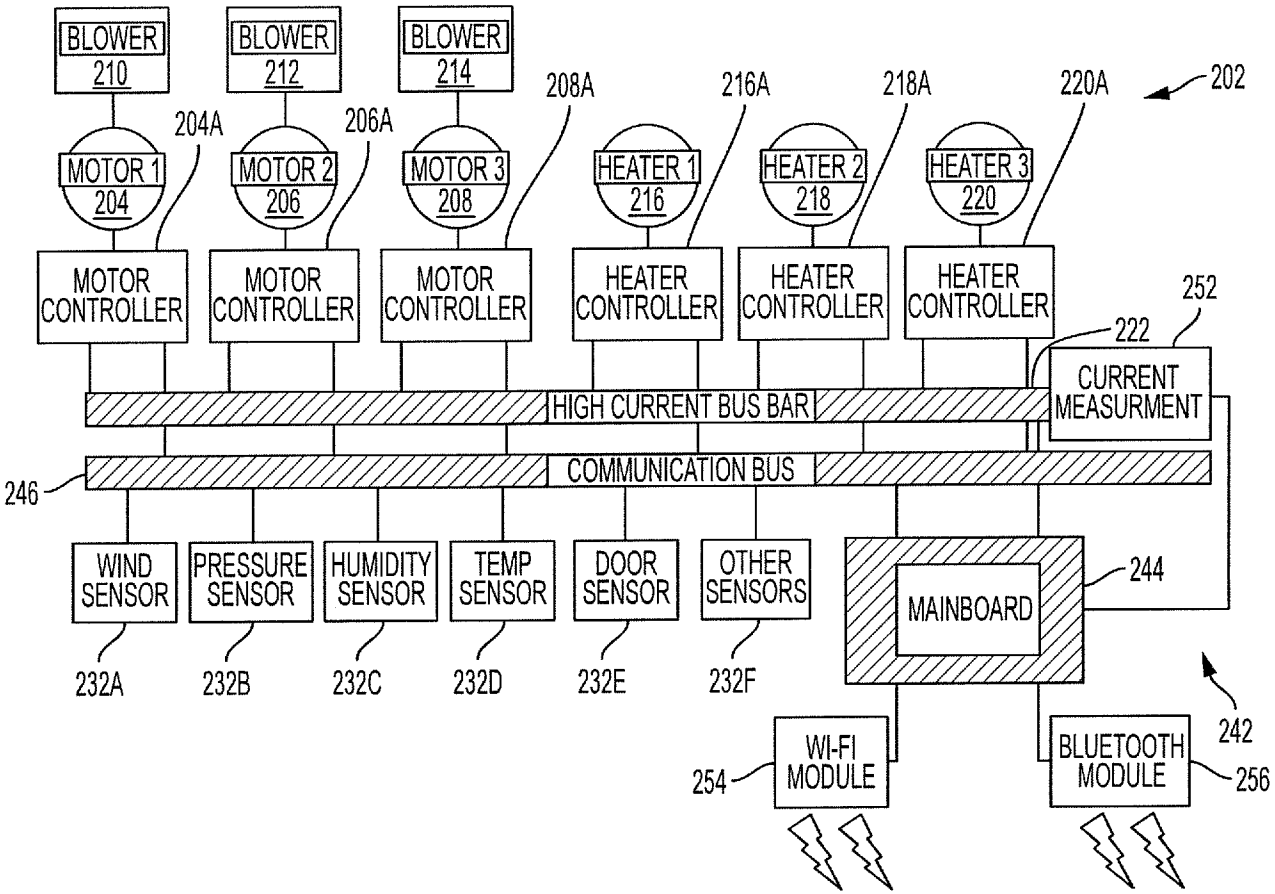
FIG. 2 includes a schematic depiction of an example of an air curtain device structured in accordance with various embodiments of the invention.

FIG. 2 illustrates an example of a schematic for an air curtain device 202 programmed and configured in accordance with various embodiments of the invention. In the example shown, the device 202 includes one or more motors 204, 206, 208, which when activated can cause one or more blowers 210, 212, 214 to direct an air current from the device 202 to generate an air curtain or air door across an opening. In certain embodiments, the blowers 210, 212, 214 may include fans powered by the motor 204, 206, 208 at one or more predetermined speeds and may include one or more directional vane structures which serve to direct air current from the device 202 at an angle or in a predetermined direction. Once generated, the air curtain may serve to cover an opening or otherwise create a barrier between different, adjacent environments, such as between the interior environment and the exterior environment of a building, for example. The motors 204, 206, 208 and the blowers 210, 212, 214 may work cooperatively with one or more heaters 216, 218, 220 or other types of air conditioning elements to adjust (e.g., increase or decrease) the temperature of the air current, for example, which is directed from the device 202. The motors 204, 206, 208 and the heaters 210, 212, 214 may be coupled through controllers (204A, 206A, 208A, 210A, 212A, 214A, respectively) to a high current bus bar 222 which supplies the components with electrical power.

The air curtain device 202 may receive input data in the form of signals generated by one or more types of sensors 232A-232F which can be configured to provide the device 202 with information regarding the environments located around the device 202. For example, a wind sensor 232A may be configured to generate and communicate signals indicative of wind velocity in one or more environments surrounding or near the device 202. A pressure sensor 232B may be configured to generate and communicate signals indicative of air pressure measurements derived from one or more environments surrounding or near the device 202, or a pressure differential between separate, adjacent environments. In another example, a humidity sensor 232C may be configured to generate and communicate signals indicative of humidity or other air quality measurements derived from one or more environments surrounding or near the device 202. A temperature sensor 232D may be configured to generate and communicate signals indicative of the air temperature or other temperature readings associated with one or more environments surrounding or near the device 202. In another example, a door sensor 232E may be configured to generate and communicate signals indicative of opening or closing of a physical door (e.g., sliding glass doors) positioned for use in the location near the device 202 and the air curtain generated by the device 202. In addition, it can be appreciated that one or more other types of sensors 232F may be employed to provide input data for the device 202. In certain embodiments, one or more other types of sensors 232F may include voltage or frequency measurement modules, for example.

In various embodiments, the air curtain device 202 may include a computer system 242 having a mainboard 244 which serves to connect various computing elements of the computer system within the device 202, such as a processor, various memory or data storage devices, video cards, sound cards, and/or other computer components which execute different tasks within the computer system 242. For example, the mainboard 244 may receive data communicated from one or more of the sensors 232, such as through a communication bus 246 (e.g., a low-speed $I^2C$ bus, or other protocols). In certain embodiments, the communication bus 246 may include one or more connectors or other devices configured in accordance with RS-422, RS-485, controller area network (CAN) bus, or another noise-resistant communication protocol. The communication bus 246 may be embodied as a serial computer bus, for example, configured for attaching low-speed peripherals to the mainboard 244 and other systems within the device 202. The computer system 242, through operation of the mainboard 244, may direct instructions to one or more of the controllers 204A, 206A, 208A, 210A, 212A, 214A by communicating signals through the communication bus 246. The mainboard 244 may also execute one or more algorithms which determine the type of signal or command to be communicated to the controllers 204A, 206A, 208A, 210A, 212A, 214A, for example. In certain embodiments, the computer system 242 may include a current measurement module 252 programmed for detecting and reporting current flowing on the high current bus bar 222, for example.

In various embodiments, the computer system 242 of the device 202 may include an network connection module 254 (e.g., a Wi-Fi module) programmed for establishing a connection between the device 202 and a computer network (e.g., Internet, intranet, or other network connection). In this manner, the device 202 may be enabled to communicate with various types of access devices such as smart phones, mobile devices, electronic tablets, or many other kinds of access devices. The computer system 242 may also include a device communication module 256 (e.g., a "Bluetooth" module) programmed for establishing communications between devices, such as between the device 202 and one or more of its operatively associated sensors 232, for example. In this manner, other devices within the vicinity of the device 202 can communicate signals or other data to the device 202, perhaps to adjust the operation of the device 202 in connection with generating an air curtain, for example.

Figure 3:
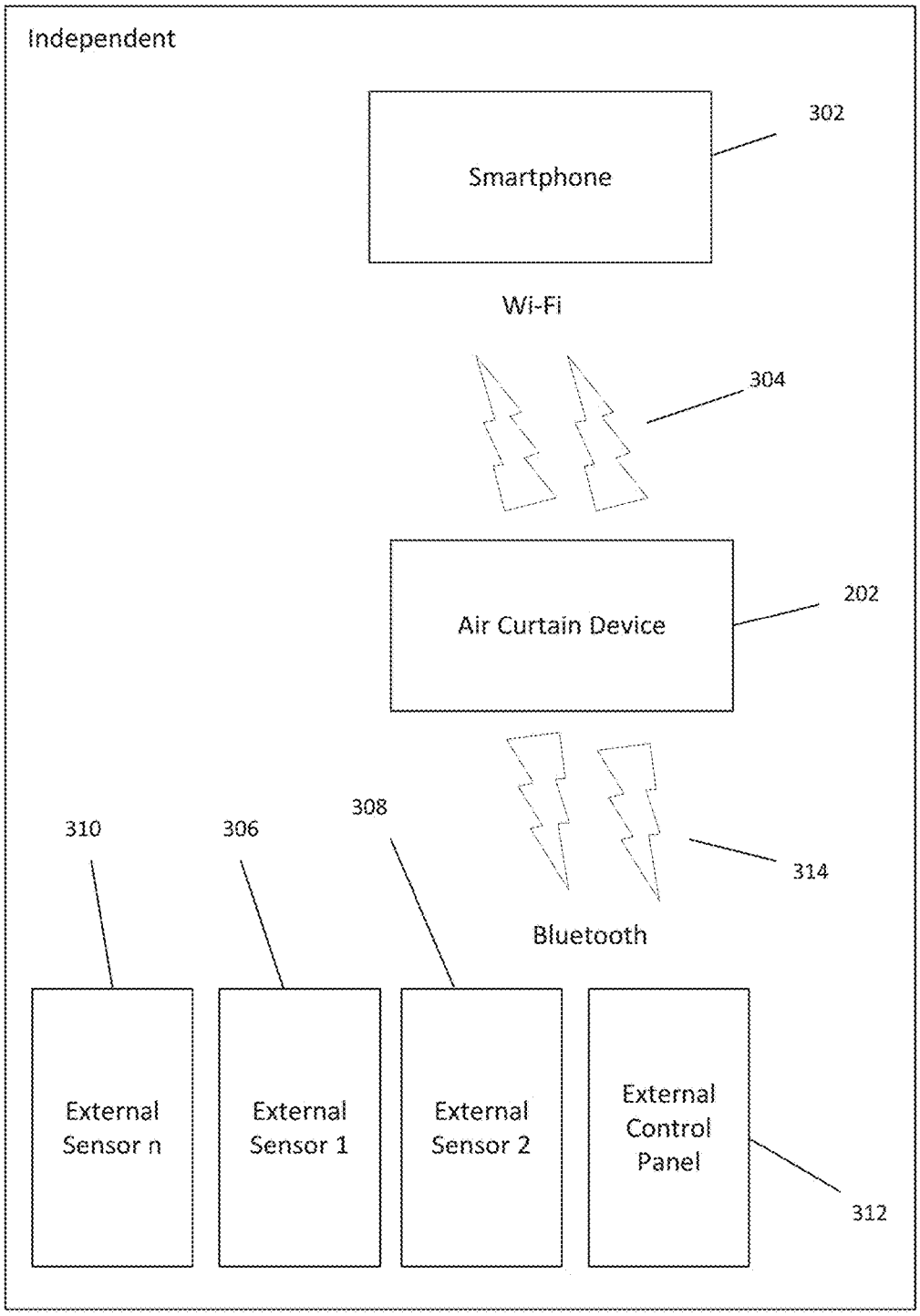
FIG. 3 includes a system architecture diagram illustrating an example of connectivity among an air curtain device, an access device, and certain sensing elements.

In one example illustrated in FIG. 3, the air curtain device 202 can communicate with one or more kinds of access devices 302 (e.g., a smart phone) through a network connection 304 (e.g., Wi-Fi connection). In addition, the device 202 can communicate with one or more external sensors 306, 308, 310 and/or an external control panel 312, such as through a device communication connection 314 (e.g., a Bluetooth connection). Similar to the sensors 232 described above, the external sensors 306, 308, 310 can be used to detect and transmit signals indicative of various environmental conditions (e.g., air temperature, wind speed, humidity, etc.) near or in the vicinity of the device 202. These signals can be communicated as input data which can be processed by the computer system 242 of the device 202, for example, or another computer system operatively associated with the device 202. The external control panel 312 may be programmed to receive and communicate commands from a user to the device 202, for example, to control or adjust operations or functions of the device 202. In this example, the device 202 may be considered to be operating in independent mode, or on a stand-alone basis separate and apart from the operation of other air curtain devices, for example. In another example, if connection 304 to the network is lost, then the device 202 can be programmed to revert to one or more default settings or operational parameters and retain its functionality for generating air curtains. In certain embodiments, in the event that connection 304 to the network is lost, control may be relinquished to the external control panel 312 of the device 202.

Figure 4:
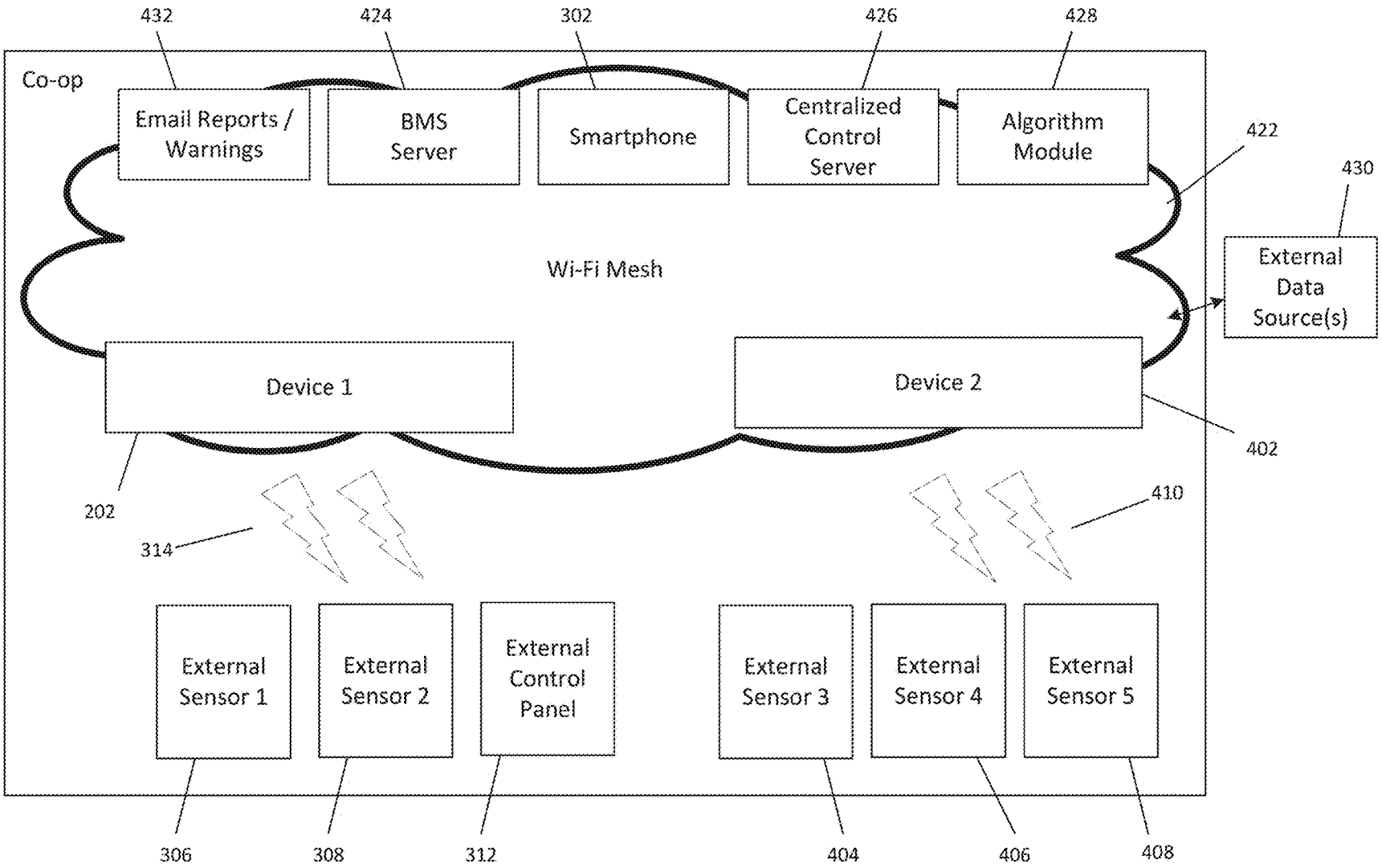
FIG. 4 includes a system architecture diagram illustrating an example of connectivity among multiple air curtain devices and a cooperatively associated wireless mesh computer architecture.

FIG. 4 includes an example of a cooperative operating mode in which tasks or operations of the air curtain device 202 may be coordinated, at least in part, with the tasks of operations of at least one other type of devices, such as another air curtain device 402. Even though only one additional device 402 is shown in FIG. 4, it can be appreciated that more than two such devices may be configured for cooperative operation consistent with various embodiments of the invention. The cooperatively associated device 402 can be programmed to communicate with one or more external sensors 404, 406, 408, such as through a device communication connection 410 (e.g., a Bluetooth connection). Similar to the sensors described above, the external sensors 404, 406, 408 can be used to detect and transmit signals indicative of various environmental conditions (e.g., air temperature, wind speed, humidity, etc.) near or in the vicinity of the device 402. These signals can be communicated as input data which can be processed by the computer system of the device 402, for example, or another computer system operatively associated with the device 402. In various embodiments, each device 202, 402 may have its own operatively associated sensors, may share one or more of the same kinds of sensors in common with the other device 202, 402, or there may be a combination of individually associated and commonly associated sensors.

In this example, the devices 202, 402 may be programmed to communicate through a wireless mesh computing architecture 422. The wireless mesh 422 may include a data collection and processing server 424 (e.g., a "BMS" server) configured to receive input data indicative of the current state of operation of each of the devices 202, 402, for example, and/or input data received from the devices 202, 402 from the external sensors 306, 308, 312, 404, 406, 408, for example. The wireless mesh 422 may also include a control server 426 programmed for directing and coordinating the execution of various tasks, functions, or other activities between or among different air curtain devices, for example. It can be appreciated that the wireless connectivity of the devices 202, 402 allows for remote programming, control, and troubleshooting of the devices 202, 402.

The wireless mesh 422 may also include an algorithm module 428 programmed for processing data received from the air curtain devices 202, 402, and/or one or more other kinds of external data sources 430. For example, one kind of external data source 430 may be a source for real-time weather-related data associated with the geography in the area in which the devices 202, 402 have been installed. In various embodiments, the algorithm module 428 may be programmed to generate adjusted or revised settings for one or more of the devices 202, 402 in association with executing cooperative operation of the devices 202, 402. These adjusted or revised settings can be then communicated to one or more of the devices 202, 402 to adjust their current mode of operation or other parameters. In one example, suppose that both devices 202, 402 have been installed at the same store location, with one device 202 installed at the north end of the store and the other device 402 installed at the south end of the store. On a given day, the store experiences different wind speed and direction at the north end in comparison to wind speed and direction at the south end, and input data representative of these different conditions can be communicated for processing by the algorithm module 428. In this example, the algorithm module 428 determines that the north end device 202 needs to alter its blower fan speed to account for a greater wind speed at the north end in comparison to the wind speed at the south end of the store.

In various embodiments, the wireless mesh 422 may include a warning module 432 programmed for communicating alerts or other notifications regarding operation of the air curtain devices 202, 402. For example, an alert may be communicated when one of the devices 202, 402 is inoperative or less than fully operational for some reason. In other embodiments, one or more directional vanes of the blowers 210, 212, 214 could be automatically adjusted based on the wind load measured by the sensors 232, for example. This would allow the device 202 to conserve more energy due to enhanced operational effectiveness. In the context of a software-based warning module 432, an alert or notification may be embodied as an e-mail communication to an access device 302 or a screen display generated on the access device 302, for example. In the context of a physical, hardware-based warning module 432, an alert or notification may be embodied as one or more kinds of visual indicators (e.g., LED or LCD lights) and/or one or more types of audible indicators (e.g., beepers), for example.

Various kinds of algorithms can be executed by the algorithm module 428, including the following operational examples. For example, an algorithm may operate with an appropriate sensor to detect the existence of insects or other pests or exhaust fumes in the vicinity of one or more of the air curation devices 202, 402, and adjust functional settings for the device 202, 402 accordingly to repel insects or fumes away from one or more door openings. In various embodiments, one or more algorithms can be executed which predict device 202, 402 usage patterns based on a reasonable combination of factors such as time, date, temperature, frequency of door actuation, such as to pre-heat air or to autonomously increase door opening or closing delay time, for example. In another example, a power consumption algorithm may be employed to adjust various aspects of the operation of a device 202, 402 (e.g., heater temperature, duty cycle, fan speed, etc.) in response to current or future energy prices. For a facility having a suitable size or volume of air space, an algorithm can be executed which takes into account current air pressure in the facility and directs one or more devices 202, 402 (equipped with appropriate inlet/outlet capabilities) to maintain a desired negative or positive air pressure in the facility. For example, positive air pressure regulation might be desirable in clean rooms or food preparation rooms. In another example, an algorithm may operate in association with a people meter, counter, or other sensor which can estimate a number of people currently located within a given facility (e.g., a crowded mall or convention hall). The algorithm can be executed to predict an amount of heat associated with the estimated number of people in the facility and to make appropriate preemptive adjustments for the operation of at least one of the devices 202, 402, in accordance with the anticipated thermal load of the populated facility. In certain embodiments, one or more of the devices 202, 402 can be equipped with a shoplifting algorithm and associated sensors to resist theft of products from a facility. In other embodiments, an algorithm may be executed in connection with an appropriate sensor to detect the presence of contaminants, smoke, fumes, or other similarly hazardous conditions within a facility. One or more of the devices 202, 402 may be actuated by such an algorithm to operate a fan to expedite evacuation of hazardous materials from the facility and/or the device 202, 402 may automatically open door access to the facility to permit people and/or hazardous materials to evacuate the facility.

In various embodiments, the device 202 may be provided with a microphone and/or voice recognition software to allow a user to adjust speed or power the device 202 on or off with voice commands. In other embodiments, the device 202 may be programmed to select its own speeds based on real time weather data and ambient background noise, for example, among other factors. For example, if the outdoor temperature and indoor temperature at the facility are the same, then there may be no reason to operate the device 202. In another example, the device 202 may be programmed to detect whether there is a low level of ambient indoor noise in the facility, wherein people may be more sensitive to noise caused by the device 202, and accordingly the device 202 may reduce motor speed to at least some extent to reduce the noise level. Conversely, the device 202 may be programmed to increase motor speed when installed in a relatively noisy environment. In various embodiments, the device 202 can use temperature differential and ambient noise level, for example, to determine an appropriate motor speed.

Figure 5:
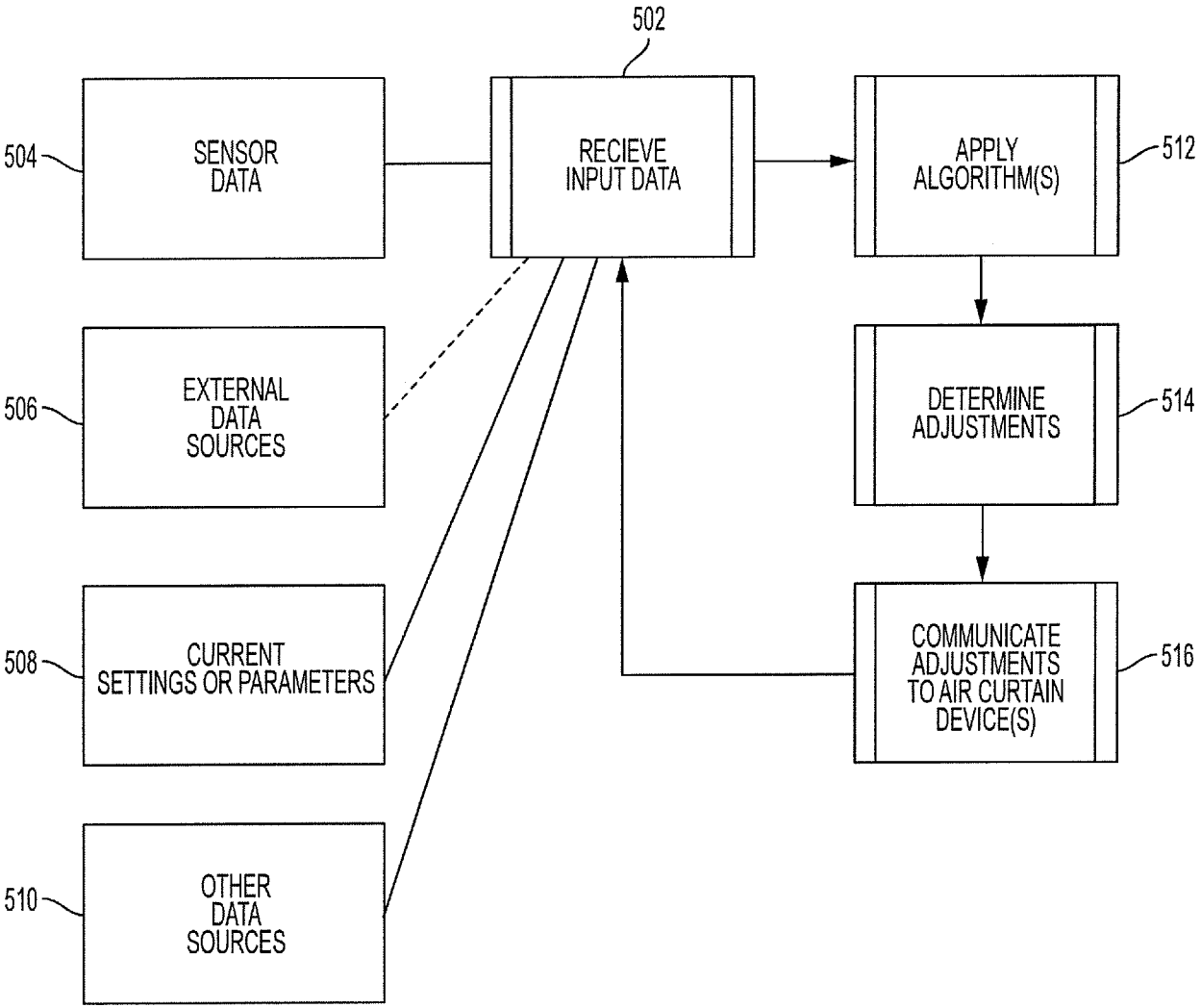
FIG. 5 includes a process flow diagram illustrating an example of processing performed by an algorithm module.

FIG. 5 includes a process flow diagram illustrating various examples of applying the algorithm module 428 to data associated with the operation of one or more air curtain devices 202, 402. At action 502, many different kinds of input data can be communicated and received by the algorithm module 428 from many different input data sources 504, 506, 508, 510. For example, sensor data 504 may be derived from sensors operatively associated with one or more of the devices 202, 402. External data 506 may be obtained from various external data sources such as weather-related databases. Current operating parameter data 508 may be derived from the current operating mode, state, or parameters of one or more of the devices 202, 402. In certain embodiments, input data may be derived or communicated from one or more other types of data sources 510. At action 512, one or more algorithms can be applied to the received input data by the algorithm module 428. The algorithm module 428 may process the data at action 514 to determine or calculate one or more recommended changes or adjustments to be applied to the operation of one or more of the devices 202, 402, for example. At action 516, one or more of the recommended changes or adjustments can be communicated back to one or more of the devices 202, 402 to change or adjust the current mode of operation of the device 202, 402.

FIGS. 6-16 include various examples of using an access device 302 to adjust, configure, or control an air curtain device in accordance with certain embodiments of the invention. During installation of an air curtain device, factors influencing the installation include effective mounting height and size of the air curtain for the air stream required. Additional criteria such as air curtain mounting location and environmental factors including determination of prevailing winds and geographic location of installation site can be considered. Also, existing conditions, such as structure pressurization, or negative pressure and threshold obstructions may be determining factors for control requirements and the performance of the air curtain device. Installation settings can be defined such as air speed setting to match application thresholds, automatic operation by interfacing with threshold access elements utilizing motion sensors, and threshold access contact sensors. In addition, supplemental heating and cooling parameters can be set for optimization of high speed fan and motor assemblies including start, delay and off cycling.

Figure 6:
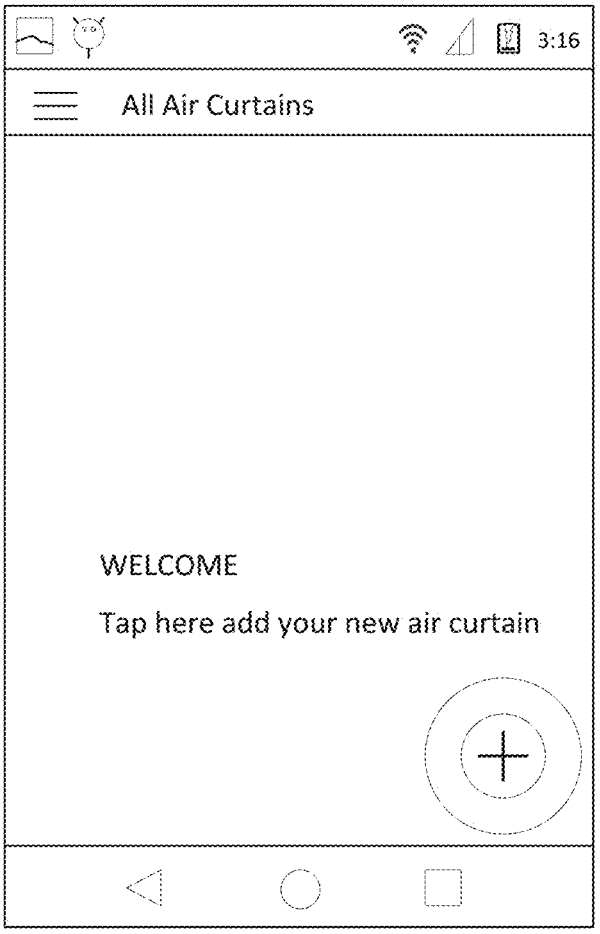
FIGS. 6-16 include conceptual illustrations of user interfaces which can be provided on an access device configured in accordance with various embodiments of the invention.
Figure 7:
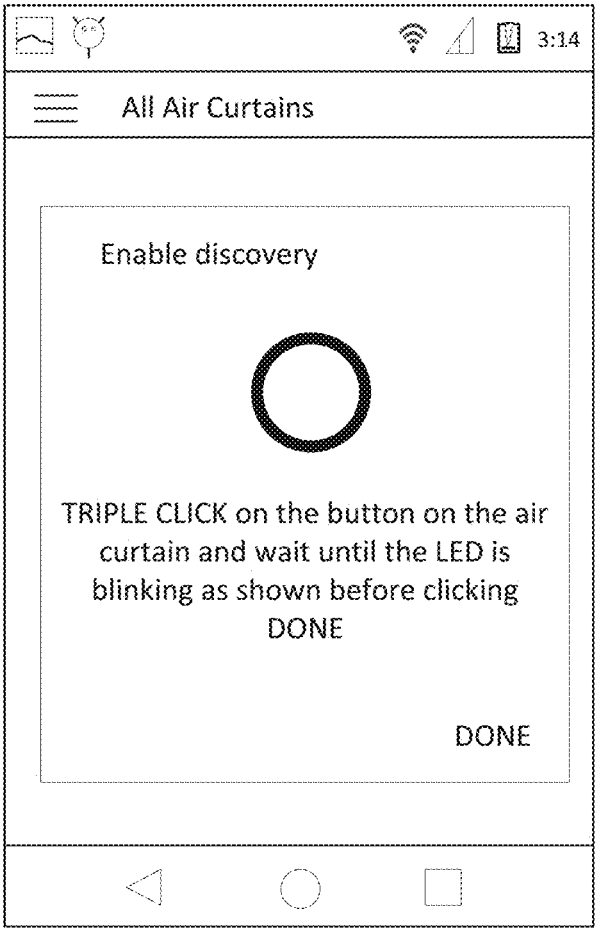

FIGS. 6 and 7 illustrate how the access device 302 can be used to configure the air curtain device 202, for example, for access to a networked communication connection, such as the Internet through a Wi-Fi connection. As shown, a user may tap the screen of the access device 302, coupled with engaging a wireless transmitter or transceiver installed on the air curtain 202, to enable "discovery" between the devices 202, 302.

Figure 8:
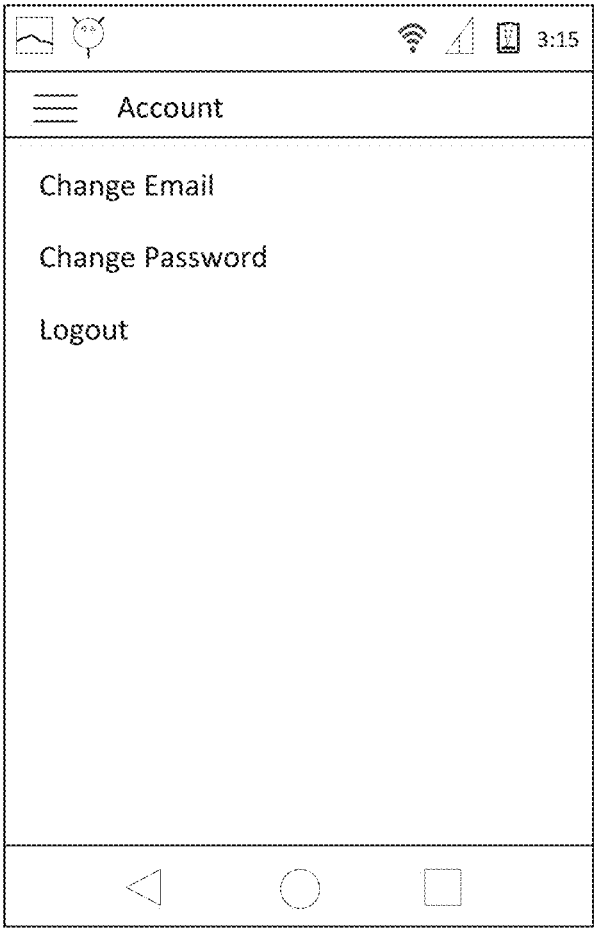
Figure 9:
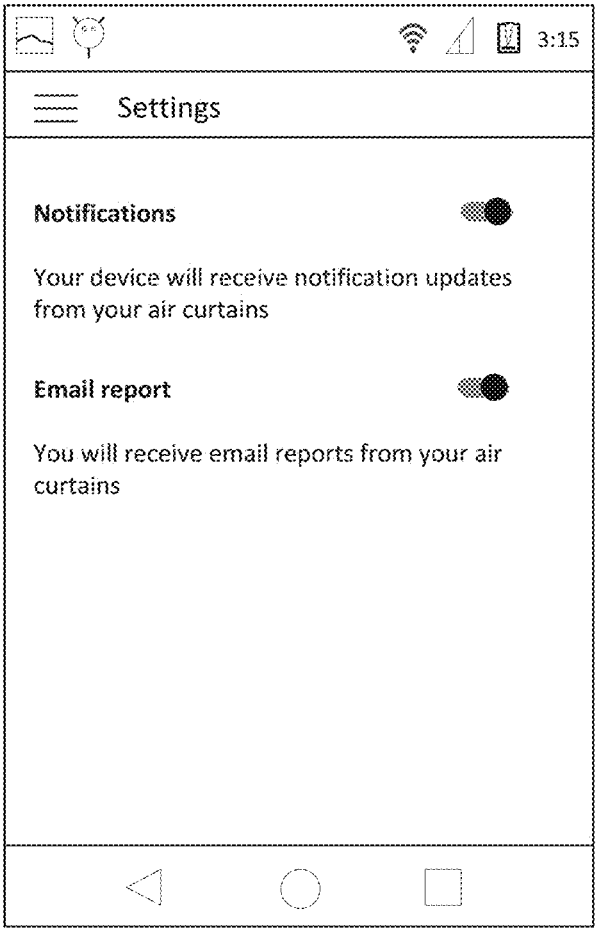

FIGS. 8 and 9 illustrate how certain administrative features can be configured on the access device 302, such as configuring e-mail address, password, notifications and reports for the device 302. Various notifications or alerts can be generated for the air curtain device 202 and displayed on the access device 302. Such notifications may be administered and communicated by the warning module 432 described above, for example. In certain embodiments, time stamp data connected to changes to different operating parameters or settings of the device 202 can be collected and noted in the form of a notification or alert.

Figure 10:
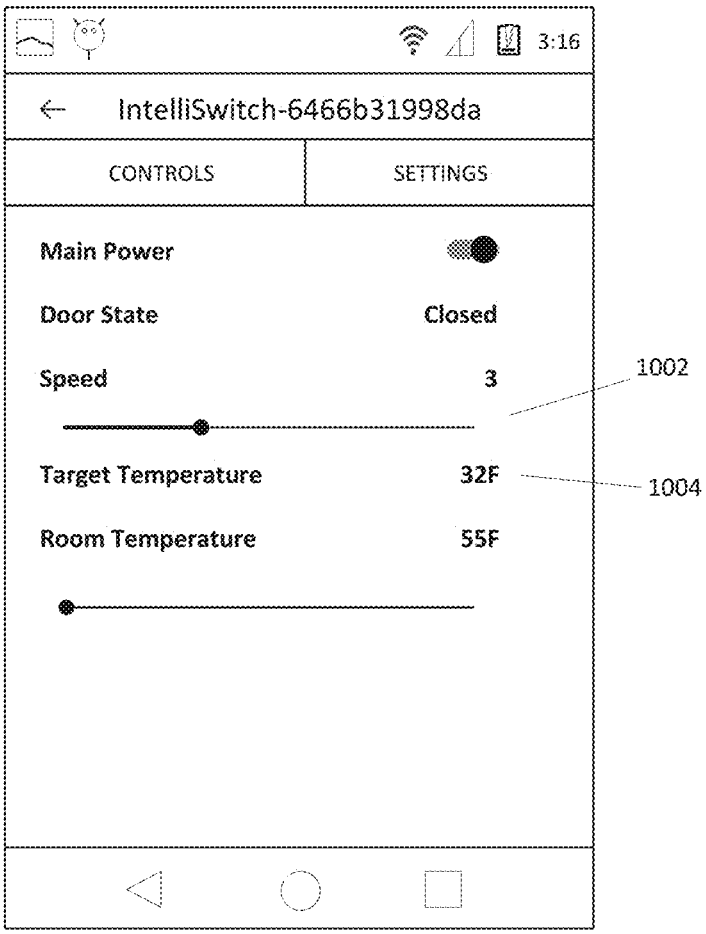
Figure 11:
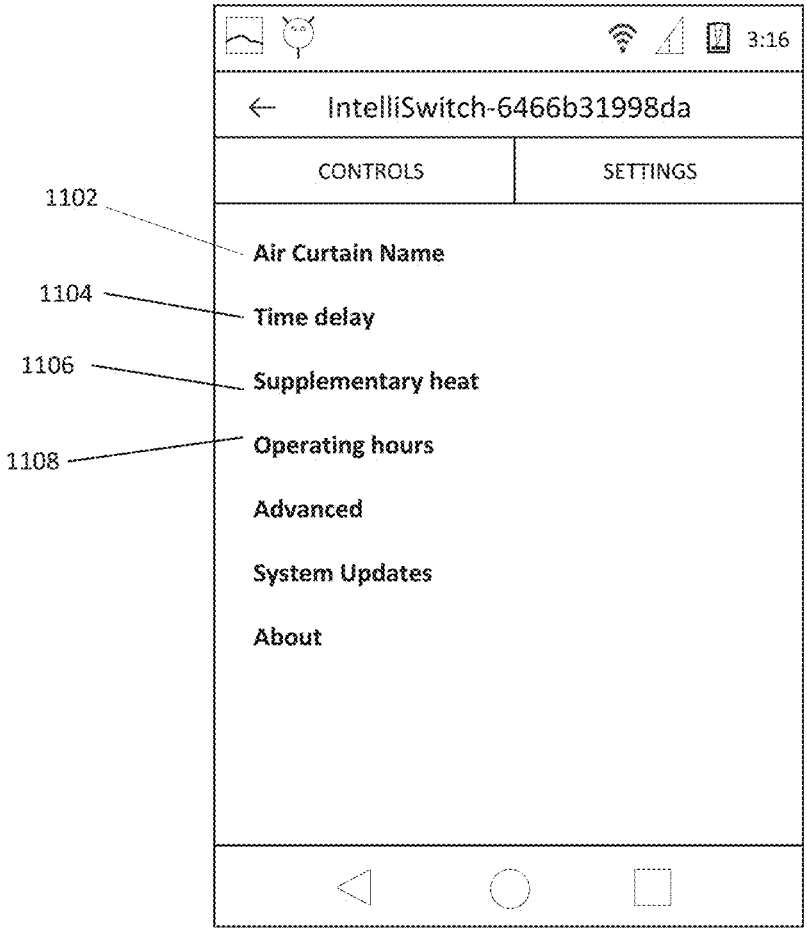

FIG. 10 illustrates examples of how various controls can be configured for an air curtain device with the access device 302. For example, a motor speed setting 1002 may be adjusted, and a target temperature setting 1004 may be modified in view of the current room temperature of the facility in which the air curtain device is operating. For example, a user can select the speed of one or more of the motors 204, 206, 208 of the device 202 and/or the temperature of one or more heaters 216, 218, 220 associated with the device 202.

FIGS. 11-16 include examples of setting various operational parameters for an air curtain device. For example, an air curtain name 1102 can be specified to make the air curtain device identifiable to a user, to other air curtain devices, and/or to a wireless network. A time delay parameter 1104 can be set to correlate the timing or time delay of the opening or closing of a door or other portal, for which the air curtain device is providing coverage, to the activation or deactivation of an air flow by the device (see FIG. 13). A supplementary heat parameter 1106 can be accessed to determine how the air curtain device will generate supplementary heat for a facility to maintain a predetermined room temperature, for example (see FIG. 14).

Figure 15:
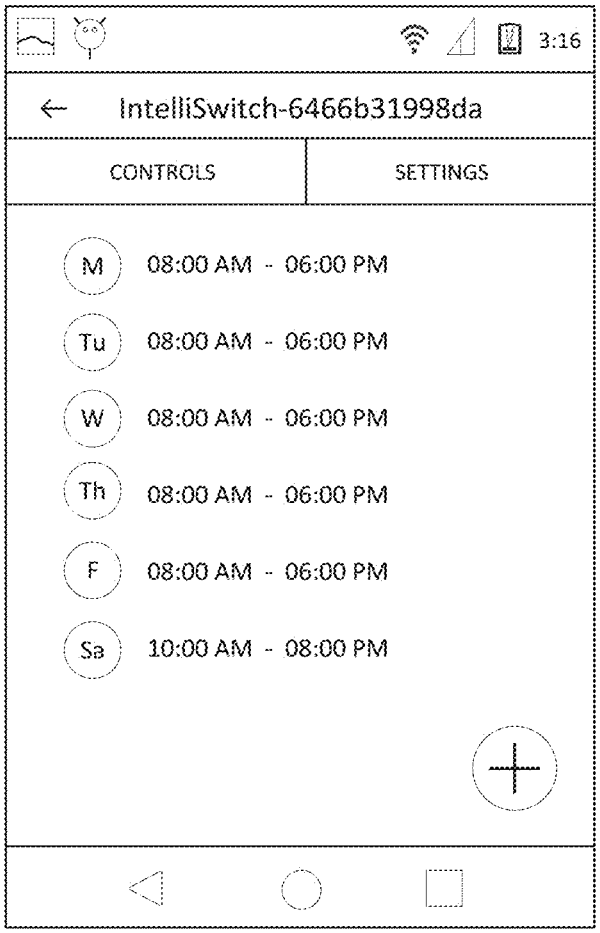
Figure 16:
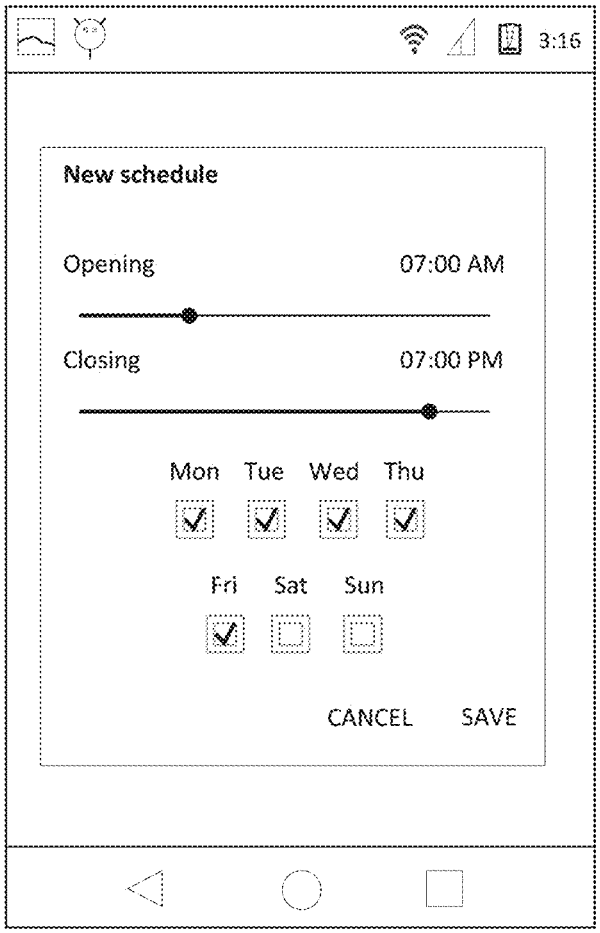

In other examples, an operating hours parameter 1108 can be accessed to specify opening and closing hours for operation of the air curtain device 202, for example, such as when a store or other facility opens or closes for business on a given day of the week or weekend. For example, the air curtain can be programmed to provide less heat to the facility during days or day parts when a less than normal volume of customers or employees are present in the facility. In certain embodiments, the device 202 can be programmed to automatically detect active or business hours for a facility, which can be determined in response to a frequency of the opening and/or closing of a door associated with the device 202 (e.g., number of door cycles). FIGS. 15 and 16 illustrate examples of modifying the operating hours parameter 1108.

Figure 12:
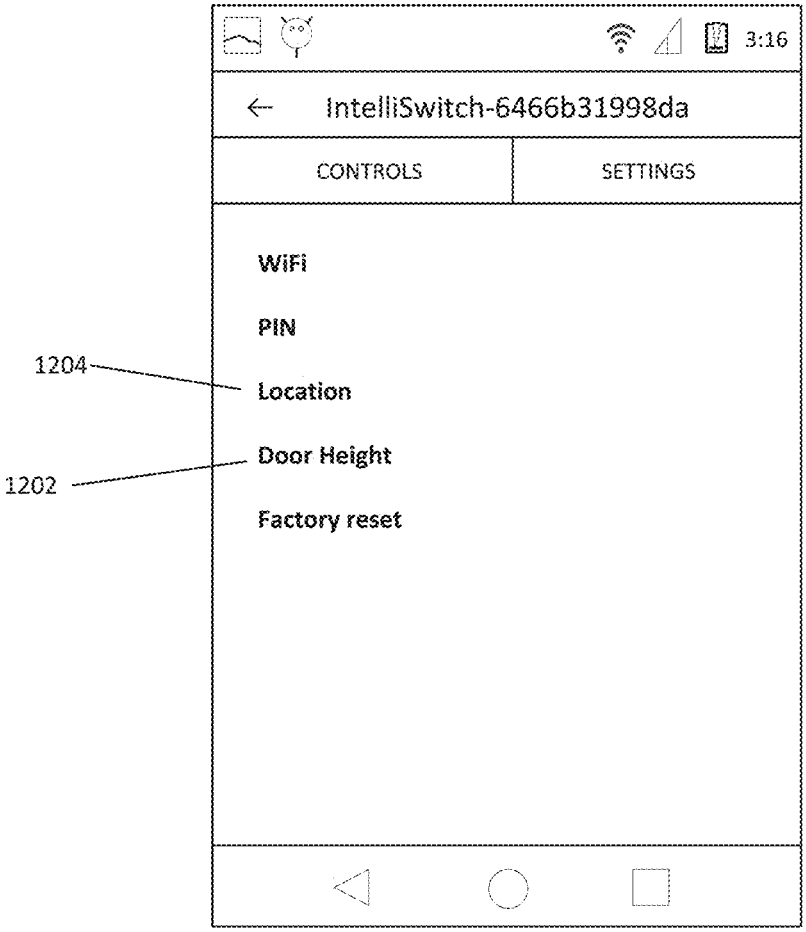
Figure 13:
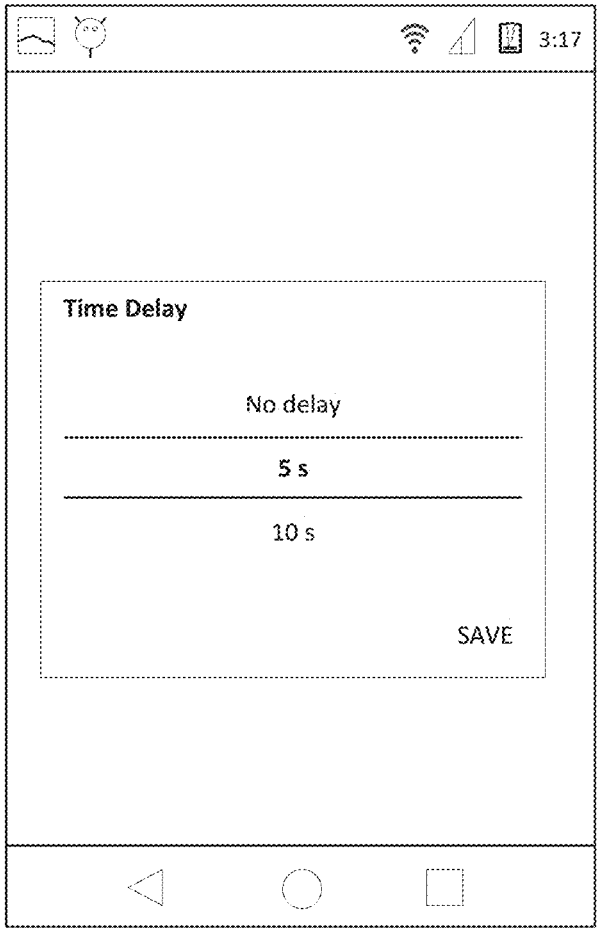
Figure 14:
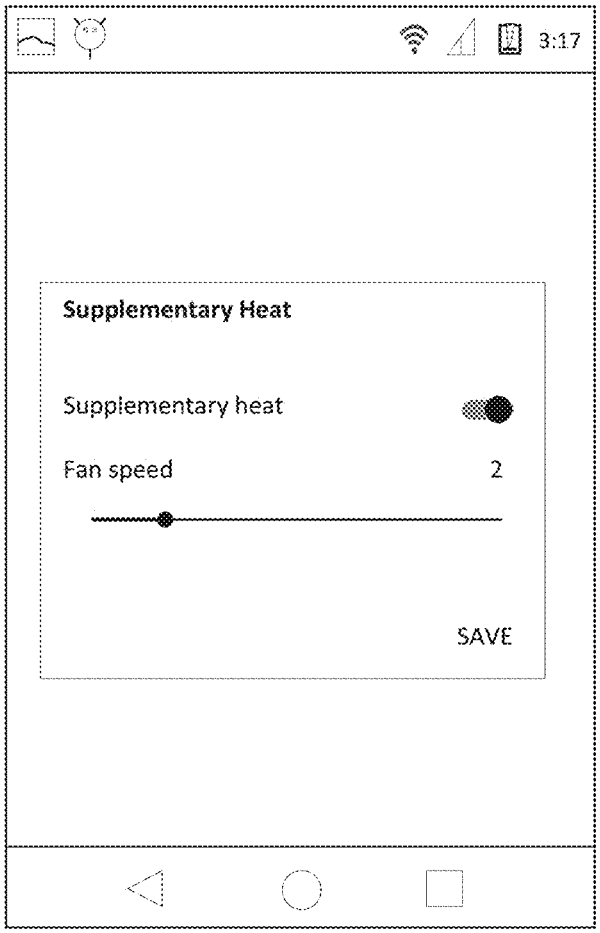

In other examples, a door height parameter 1202 can be set for the air curtain device 202, which may be the door or other opening for which the device 202 will operate to provide coverage by generating an air current. FIG. 12 illustrates an example of a location parameter 1204 (e.g., by geography or street address) where the device 202 will be operative. It can be appreciated that supplying such location data can be useful for obtaining weather-related data associated with the location and/or calculating energy savings obtained through use of the device 202 at the location. It can be seen that connection to a wireless network also allows the controls system of the device 202 to "know" its own location. This can enable the device 202 to access real time weather data, for example, which can be used to adjust fan speed, temperature setting, air stream direction, and to collect input data such as hourly temperatures, humidity data, and wind speed data for use in an energy savings algorithm. In certain embodiments, assessments and activities involving door open time, customer traffic, security footage (e.g., video cameras), shoplifting prevention, and advertising can be performed by virtue of positioning the device 202 above a customer entry door of a facility.

Figure 17:
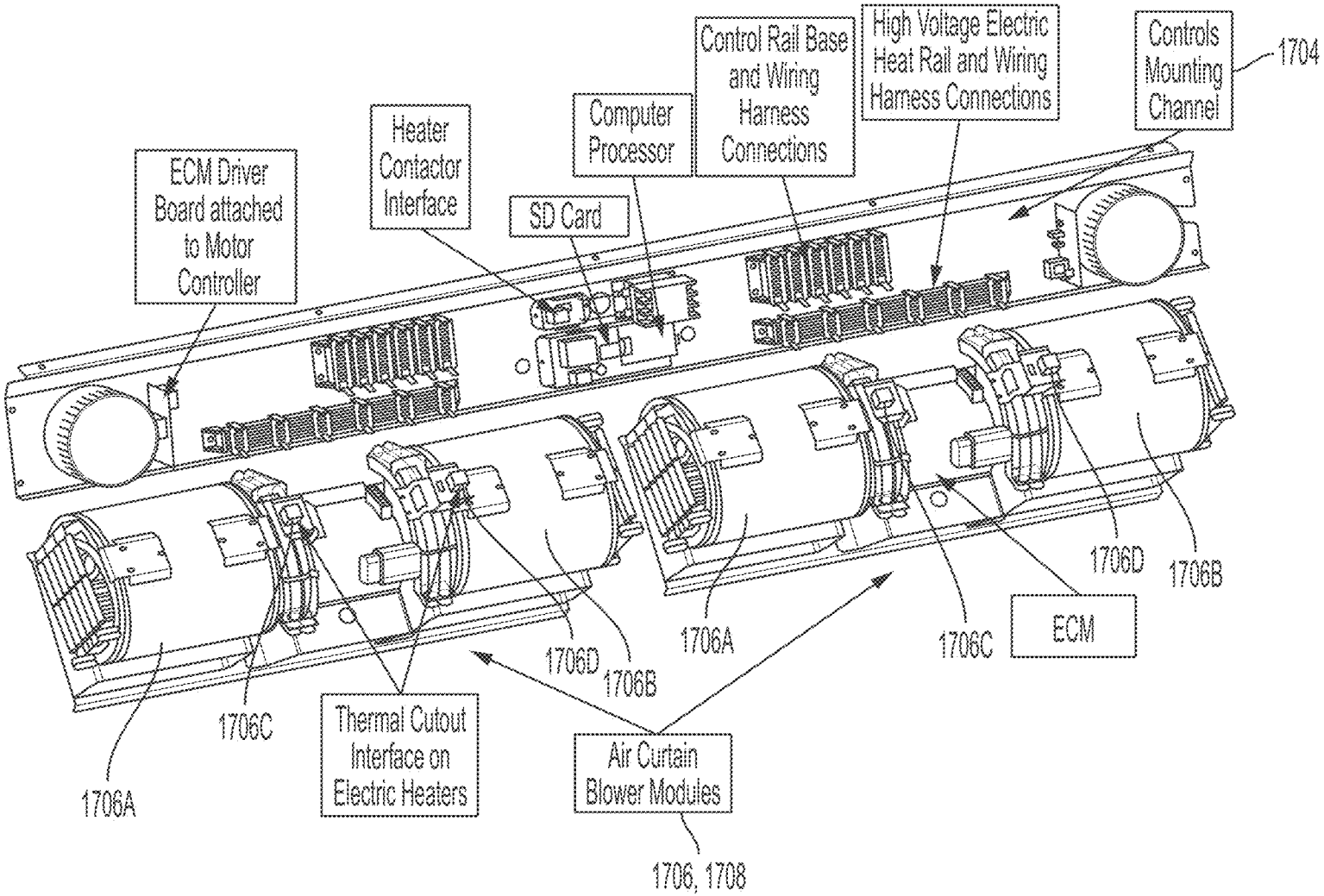
FIG. 17 includes a partially schematic, three-dimensional view of an air curtain device structured in accordance with certain embodiments of the present invention.

FIG. 17 includes examples of different manufacturing aspects of assembling an air curtain device 1702 in accordance with various embodiments of the invention. As shown, the device 1702 includes a controls mounting channel 1704 which provides a platform for installing various computer system components, control devices, system interface components, and memory devices, among others, for operation within the device 1702. The device 1702 includes two blower modules 1706, 1708, which each comprise two fan assemblies 1706A, 1706B, 1708A, 1708B (respectively), and two heaters 1706C, 1706D, 1708C, 1708D (respectively). In addition, each blower module 1706, 1708 can be operatively associated with a motor 1706E, 1708E (respectively) configured to drive the fan assemblies 1706A, 1706B, 1708A, 1708B to generate air current from the device 1702. The heaters 1706C, 1706D, 1708C, 1708D can be employed to adjust the temperature of air generated by the device 1702, including generating heat for the interior of a facility, for example, even perhaps when the device 1702 is not otherwise required to generate an air current to cover an open door.

Figure 18:
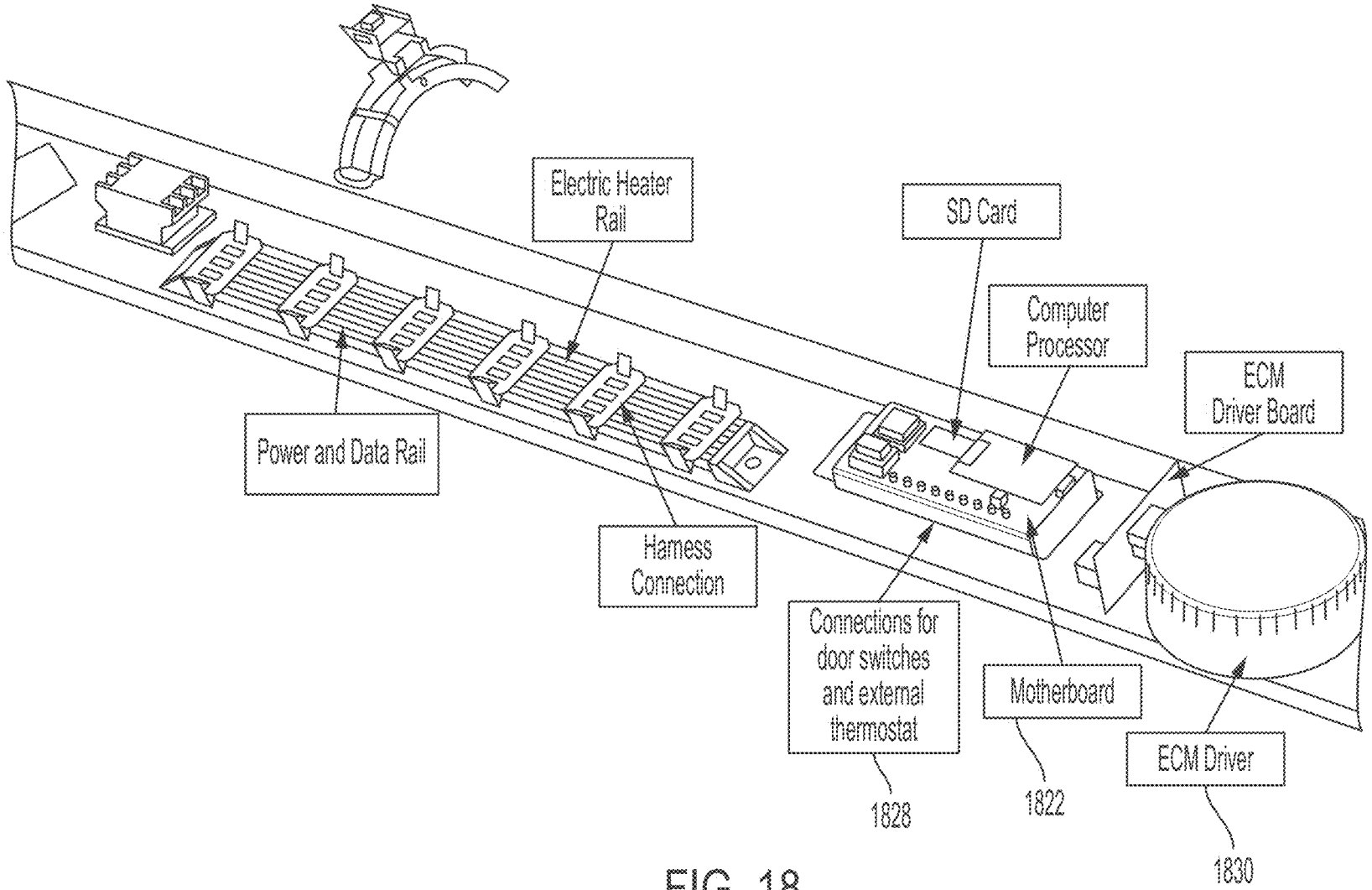
FIGS. 18 and 19A include partially schematic, three-dimensional views of an air curtain device structured in accordance with certain embodiments of the present invention.
Figure 19A:
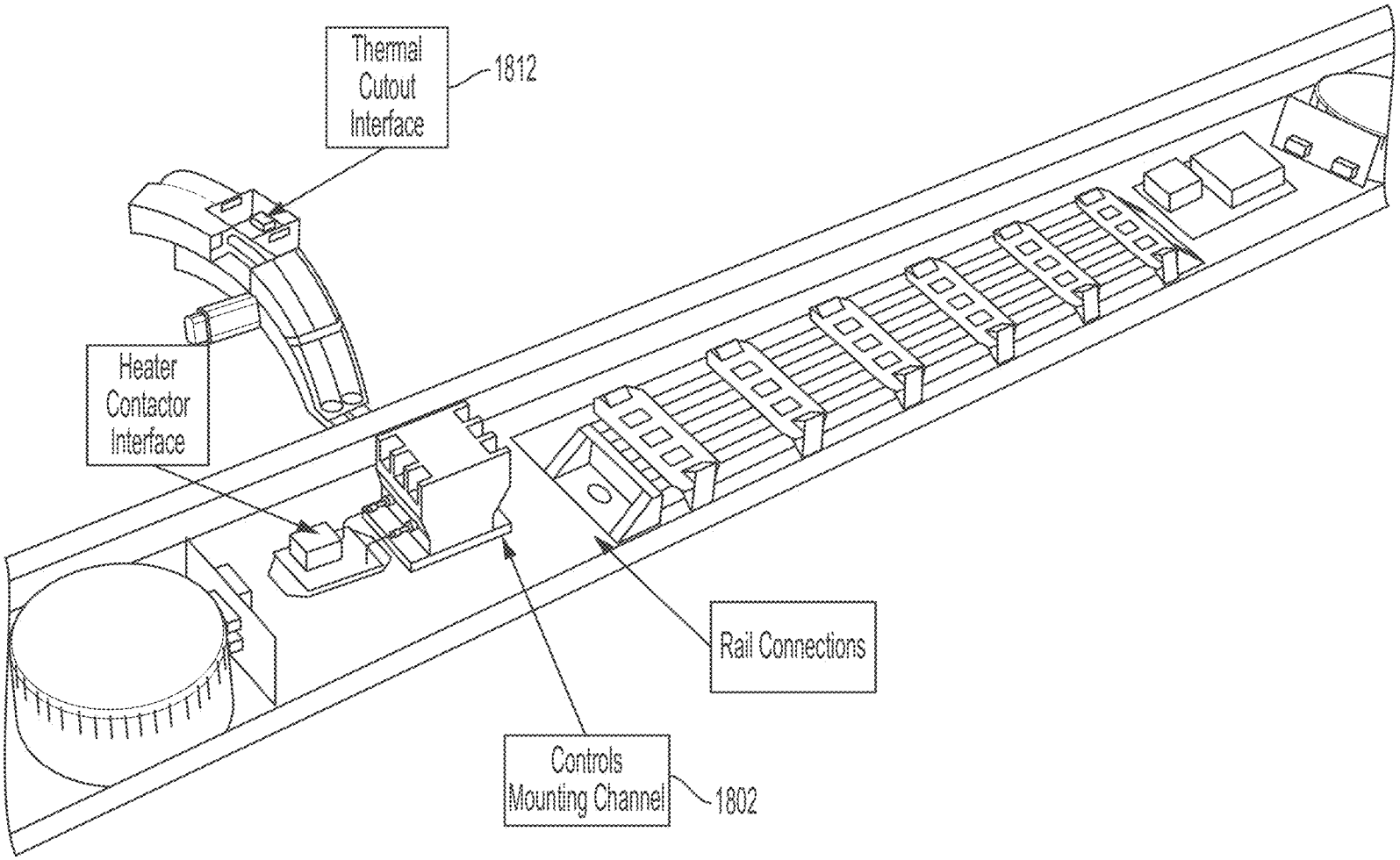

FIGS. 18 and 19A illustrate certain components of another embodiment of a controls mounting channel 1802 which can be used in association with the air curtain device 1702 shown in FIG. 17. In the example shown, the controls mounting channel 1802 provides a platform for installation of a power and data rail 1804 and an electric heater rail 1806. The power and data rail 1804 may be configured to supply power to various components of the device 1702, and to serve as a path for communicating data signals between and among various components of the device 1702. The electric heater rail 1806 may supply power to one or more of the heaters 1706C, 1706D, 1708C, 1708D of the device 1702 such as heater 1706D. A heater contactor interface 1810 can be configured to relay electrical power to the heaters 1706C, 1706D, 1708C, 1708D of the device 1702 and may be operative as a switch for supplying or removing electrical power. A thermal cut-out interface 1812 can be provided for determining whether or not to supply electrical power to the heaters of the device 1702 subject to a predetermined temperature level.

In various embodiments, a mainboard 1822 of the device 1702 may include various components operative in connection with a computer system of the device 1702. The mainboard 1822 may include a processor 1824 (e.g., a trade-designated "Raspberry Pi" processor) for directing and executing various computing tasks within the computer system, such as directing the operation of various controllers within the device 1702, for example. A memory device 1826 (e.g., SD card) may be provided for storing various data collected or processed by the device 1702. Various connections 1828 may be provided for detecting when a door associated with the device 1702 has been opened, for example, and for establishing connectivity with external controls such as an external thermostat. In certain embodiments, a motor driver 1830 and a motor driver board 1832 may be provided for controlling and directing the operation of one or more of the motors 1706E, 1708E of the device 1702. The motor driver board 1832 may receive commands communicated from the mainboard 1832 to adjust the speed of the motor, for example.

In various embodiments described herein, one or more motors may be embodied as electronically commutated motors ("ECMs"), which facilitates programming of the motor drivers 1830 to drive the ECMs. For many applications in the HVAC area, ECM motors can enhance energy efficiency and can be more precisely controlled than other types of moors. In certain embodiments, the use of an ECM is advantageous for allowing the air curtain device to operate in a destratification mode. In destratification mode, the device 1702 may be programmed to operate continuously to intake warmer air near the ceiling of a facility, for example, and push the warmer downward toward the floor of the facility to provide a better mixture of warmer and colder air in the environment of the facility. This mode saves energy by not having to heat air nearer to the ceiling to a point above that required within the facility. The device 1702 may be further programmed to sample mixed air in the destratification mode and provide alerts and/or e-mail reports.

It can be seen that the modular construction of the air curtain devices described herein allows for separate boards for mainboards (e.g., power supplies and logic), motor drivers, switches, and heaters. This modular construction facilitates convenient placement of components during assembly and for use on other devices or configurations. In one example, the mainboard could be replaced while retaining the same motor driver and heater control boards. The mainboard can be constructed to allow the use of an aftermarket CPU board (e.g., the "Raspberry Pi" processor). This can provide for economy of scale capabilities, multiple USB connections, technical support, and the ability to upgrade without making dramatic changes to the mainboard. For example, the CPU may be able to accept Wi-Fi dongles for allowing the air curtain device to connect to a WiFi network.

In certain embodiments, the power rail 1804 can be considered a large scale, unitarily structured "breadboard" which can help to speed assembly of the air curtain device 1704 by minimizing the amount of manual wiring required with flexible premade connections. The power rail 1804 can be flexible in how it can be connected, so the same length of rail could be used in many different air curtain configurations. The power rail 1804 may include multiple conductors running the length of the assembly, and the conductors may include tabs which can be readily connected to commercially available wiring quick connects. Each rail conductor of the power rail 1804 may be used for a discrete purpose, such as for supplying power to the heaters or for establishing data communication channels, for example. The data communications channels can allow processors from different modules to communicate with each other. In certain embodiments, the power rail 1804 can also be configured to connect to a wiring harness, to further speed up and reduce mistakes in the wiring process. In addition, the power rail 1804 can be used on many devices that do not already have a modular control architecture.

Figures 19B, 19C, 19D, 19E, 19F, 19G:
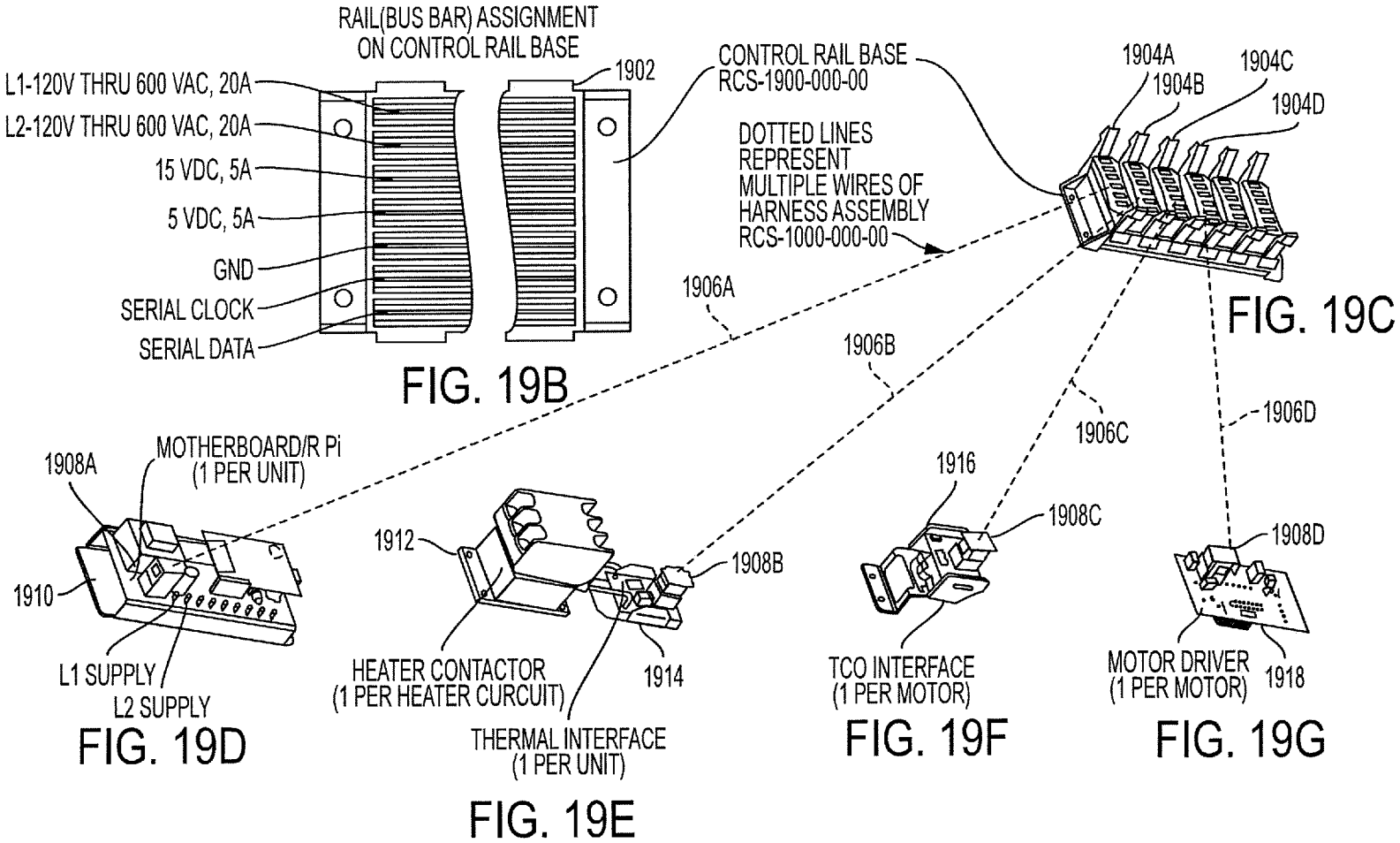
FIGS. 19B through 19Q illustrate examples of various components which may be employed in association with a unitarily structured control rail base provided in accordance with certain embodiments of the invention.
Figure 19H:
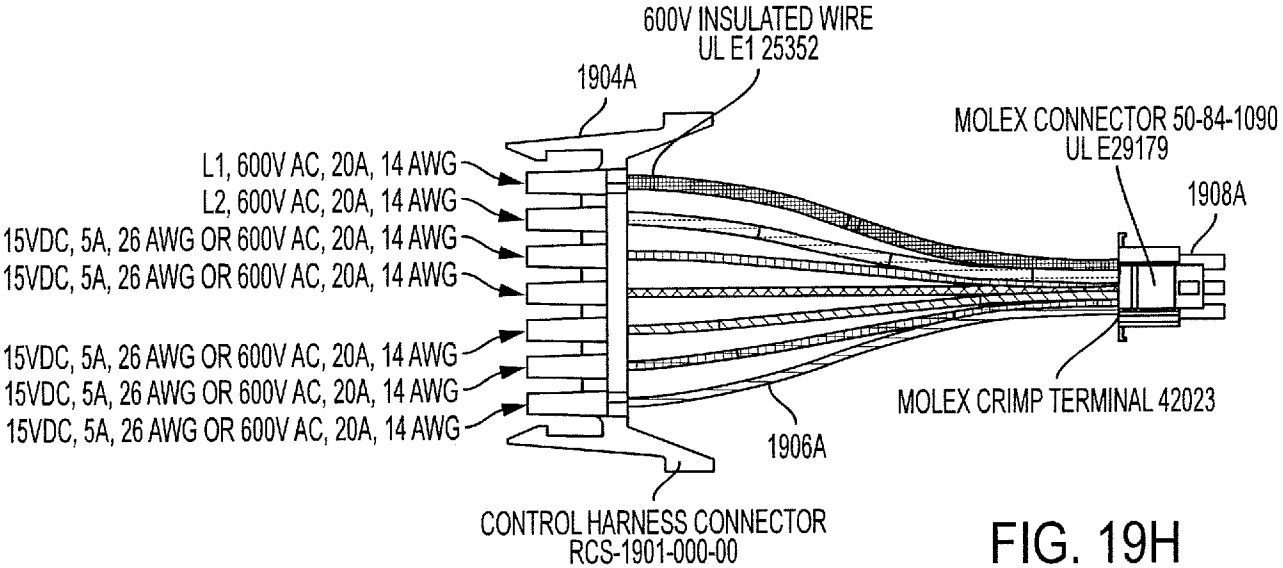
Figure 19I:
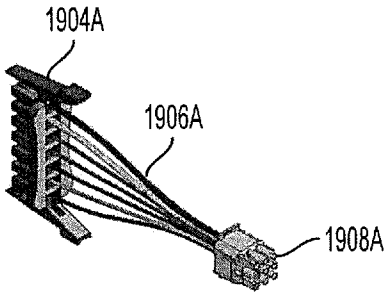
Figure 19L:
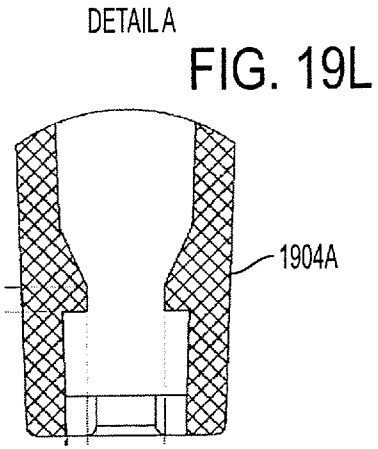
Figure 19K:
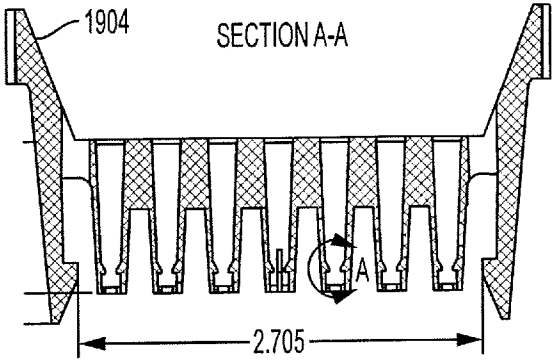
Figure 19J:
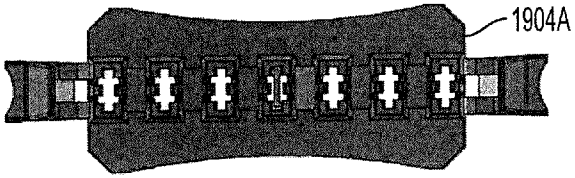
Figure 19M:
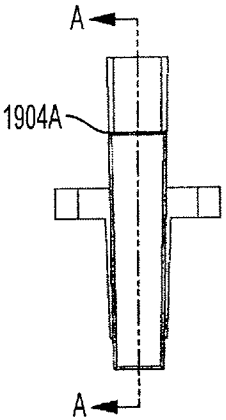
Figure 19N:
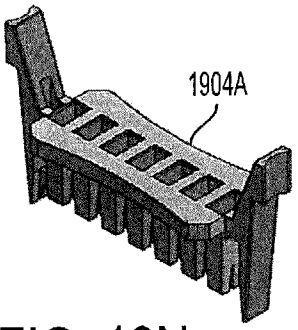
Figure 19Q:
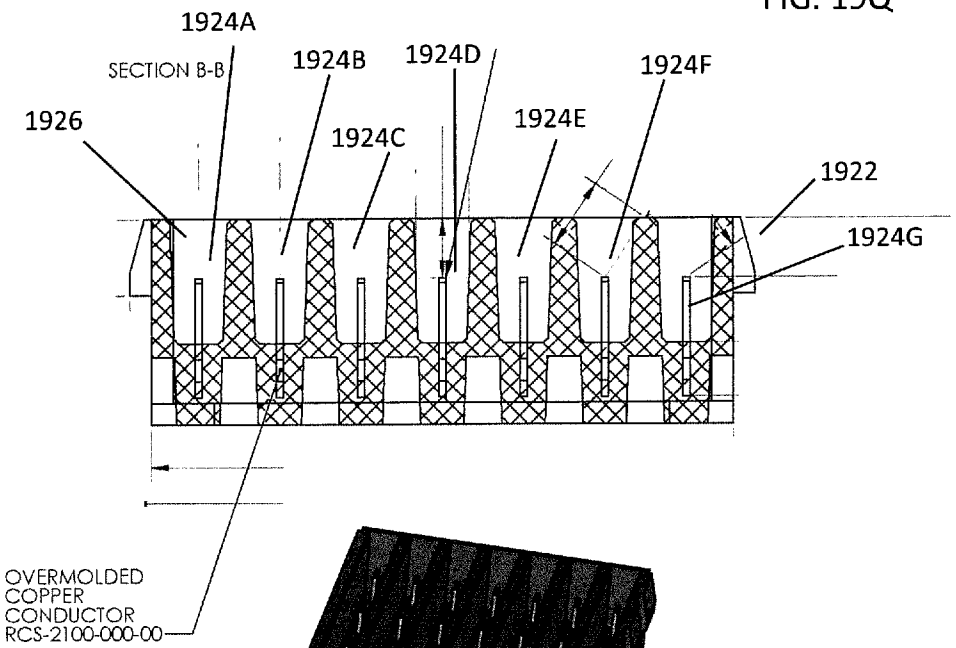
Figure 19P:
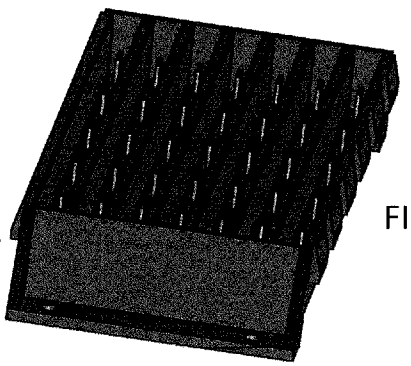
Figure 19O:
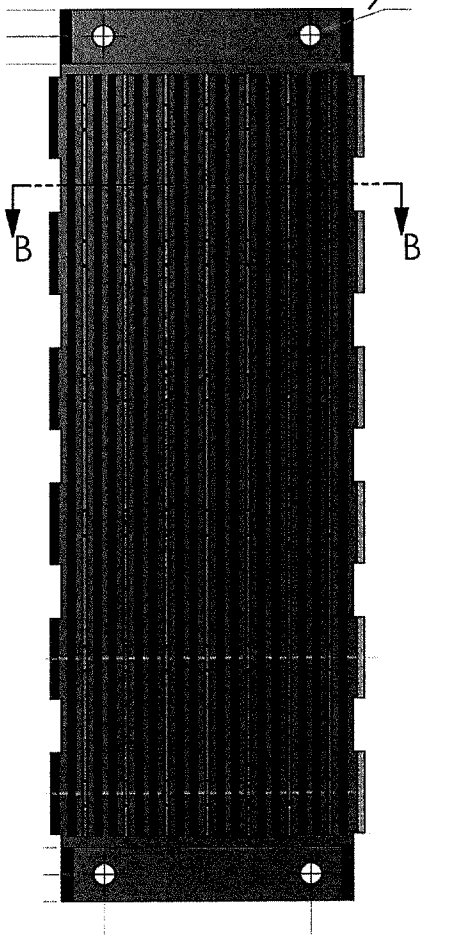

FIGS. 19B through 19Q illustrate examples of various components which may be employed in association with a unitarily structured control rail base 1902 provided in accordance with certain embodiments of the invention. The control rail base 1902 can be structured to receive therein multiple control harness connectors 1904A-1904D (as shown in FIG. 19C). In the context of the examples illustrated in FIGS. 19B-19N, each of the control harness connectors 1904A-1904D may be connected through a wire harness assembly 1906A-1906D (respectively) to various components through wire connectors 1908A-1908D (respectively) associated with each component. The components connectable to the control rail base 1902 may include a motherboard 1910; a heater contactor 1912 and its operatively associated thermal interface 1914; a thermal cut-out ("TCO") interface 1916; a motor driver 1918; and/or a variety of other components used in connection with the operation of an air curtain device. FIGS. 19O through 19Q illustrate an example of a control rail base 1922 including multiple conductors 1924A-1924G formed therein and structured to receive various control harness connectors 1904 therein. It can be seen that various pockets of the rail base 1922 (such as pocket 1926) are dimensioned to resist the fingers or other appendage of a human user from directly contacting the conductors 1924A-1924G. It can be seen that the unitary structure of the control rail base 1902 can facilitate ready and efficient assembly of an air curtain control device while limiting installation errors and promoting user safety.

Figure 20:
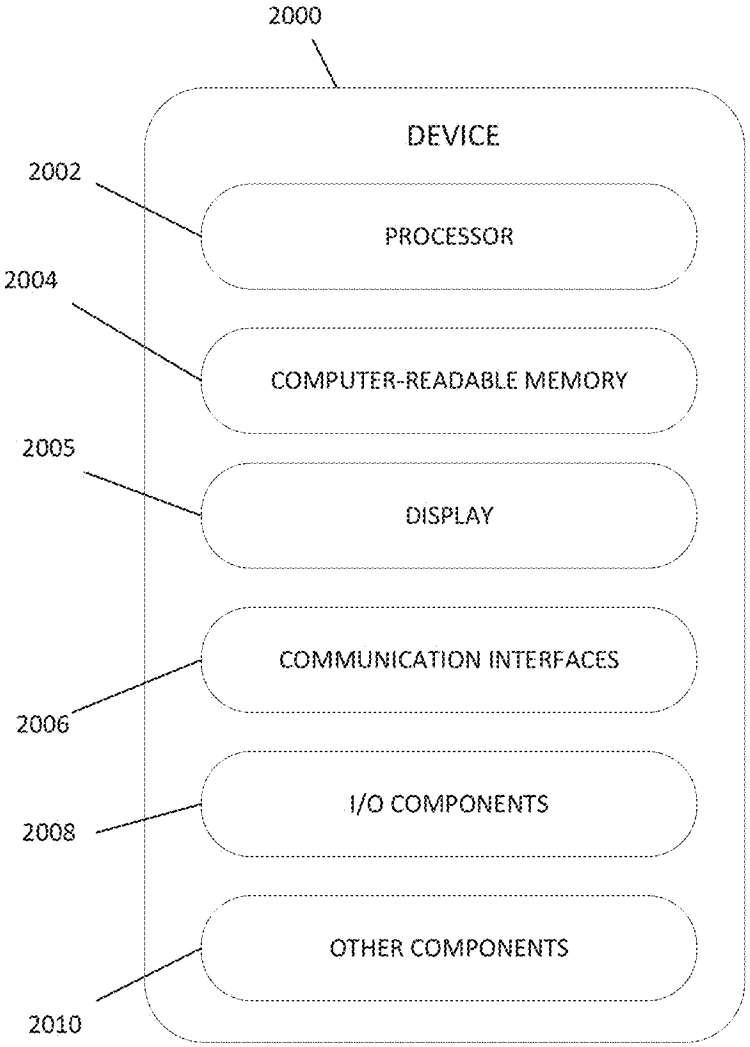
FIG. 20 includes a block diagram illustrating an example of an access device.

FIG. 20 illustrates select example components of the access device 2000 that may be used to implement the functionality described above according to some implementations. In a very basic configuration, the access device 2000 includes, or accesses, components such as at least one processor 2002 and computer-readable media 2004. Each processor 2002 may itself comprise one or more processors or cores. Depending on the configuration of the access device 2000, the computer-readable media 2004 may be an example of non-transitory computer storage media and may include volatile and nonvolatile memory and/or removable and non-removable media implemented in any type of technology for storage of information such as computer-readable instructions, data structures, program modules or other data. Such computer-readable media includes, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the processor 2002 directly or through another computing device. Accordingly, the computer-readable media 2004 may be computer-readable media able to maintain instructions, modules or components executable by the processor 2002.

The computer-readable media 2004 may be used to store any number of functional components that are executable by the processor 2002. In certain embodiments, these functional components comprise instructions or programs that are executable by the processor 2002 and that, when executed, implement operational logic for performing the actions attributed above to the access device 2000. The computer-readable media 2004 may also store data, data structures, and the like that are used by the functional components. The access device 2100 may include the display 2005, which may be passive, emissive or any other form of display.

One or more communication interfaces 2006 may support both wired and wireless connection to various networks, such as cellular networks, radio, WiFi networks, short-range or near-field networks (e.g., Bluetooth®), infrared signals, local area networks, wide area networks, the Internet, and so forth. For example, the communication interface 2006 may allow a user of the access device 2000 to access the World Wide Web, download digital works and supplemental information from the infrastructure or repository 2004, access supplemental online content, such as a from a website or other network location, and the like. The communication interface 2006 may further allow a user to access storage on another device, such as a user's computing device, a network attached storage device, or the like. In another example, a near-field network could enable an air curtain device to pair or communicate with an external sensor or an access device, making set up and installation of such devices more convenient.

The access device 2000 may further be equipped with various other input/output (I/O) components 2008. Such I/O components 2008 may include a touchscreen and various user controls (e.g., buttons, a joystick, a keyboard, a mouse, etc.), speakers, a microphone for capturing user speech and other sounds, different types of cameras for detecting user motions and gestures, connection ports, and so forth. The I/O components 2008 may also include various types of general purpose I/O (GPIO) devices used to control logic devices such as transistor switches, logic gates, and non-standard communication protocols. User controls may include page turning buttons, navigational keys, a power on/off button, selection keys, and so on. Additionally, the access device 2000 may include various other components 2010 that are not shown, examples of which include removable storage, a power source, such as a battery and power control unit, a global positioning system (GPS) device, a PC Card component, and so forth.

In certain embodiments, another component may be a text-to-speech module programmed to convert text displayed on the device 2000, for example, into audio data representing a verbal speech version of that text. In certain embodiments, the device 2000 may be programmed to generate audio data for only the key excerpts identified for a given piece of digital content, and not other portions of the content.

Figure 21:
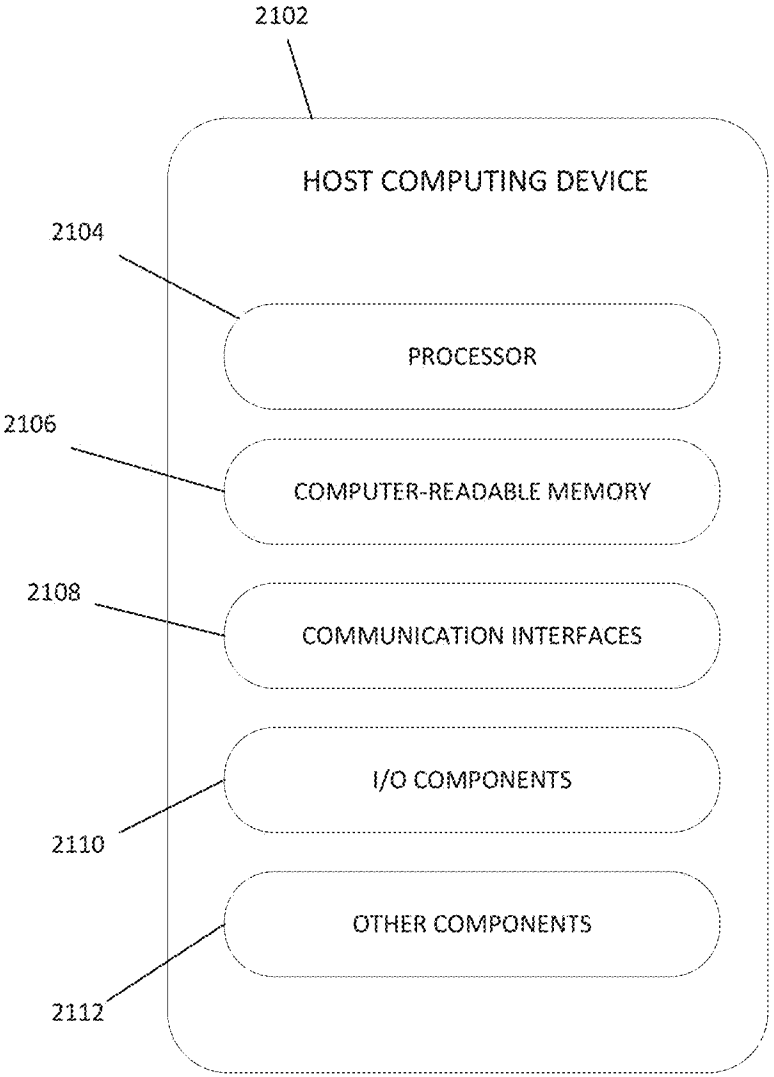
FIG. 21 includes a block diagram illustrating an example of a host computing device.

FIG. 21 illustrates select components of an example server, computer, or host computing device 2102, one or more of which may be configured to perform various processes described herein, including tasks, functions, or activities performed by various embodiments of the wireless mesh computer architecture described above. The host computing device 2102 may include one or more processors 2104, computer-readable media 2106, and one or more communication interfaces 2108. The processor(s) 2104 may comprise a single processing unit or a number of processing units, and may include single or multiple computing units or multiple cores. The processor(s) 2104 can be configured to fetch and execute computer-readable instructions stored in the computer-readable media 2106 or other computer-readable media. The computer-readable media 2106 may include volatile and nonvolatile memory and/or removable and non-removable media implemented in any type of technology for storage of information, such as computer-readable instructions, data structures, program modules or other data. Such computer-readable media includes, but is not limited to, RAM, ROM, EEPROM, flash memory or other memory technology, CD-ROM, digital versatile disks (DVD) or other optical storage, solid state storage, magnetic disk storage, RAID storage systems, storage arrays, network attached storage, storage area networks, cloud storage, or any other medium that can be used to store the desired information and that can be accessed by a computing device. Depending on the configuration of the computing device 2102, the computer-readable media 2106 may be a type of computer-readable storage media and may be a non-transitory storage media.

Also, any logic or application described herein that comprises software or code can be embodied in any non-transitory computer-readable medium for use by or in connection with an instruction execution system such as a processing component in a computer system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system.

The computer-readable media 2106 may be used to store any number of functional components that are executable by the processors 2104. In many implementations, these functional components comprise instructions or programs that are executable by the processors 2104 and that, when executed, implement operational logic for performing the various actions described herein. The computer-readable memory may also be used for storing multiple book packages such as the book packages described herein.

The host computing device 2102 may include communication interface(s) 2108, which may include one or more interfaces and hardware components for enabling communication with various other devices, such as the access devices 2100, over a wide-area network such as the Internet.

The host computing device(s) 2102 may further be equipped with various input/output components 2110. Such I/O components 2110 may include a display, various user interface controls (e.g., buttons, mouse, keyboard, touch screen, etc.), audio speakers, connection ports and so forth.

The host computing device(s) 2102 may also include many other logical, programmatic and physical components 2112, of which those described above are merely examples that are related to the discussion herein.

Figure 22:
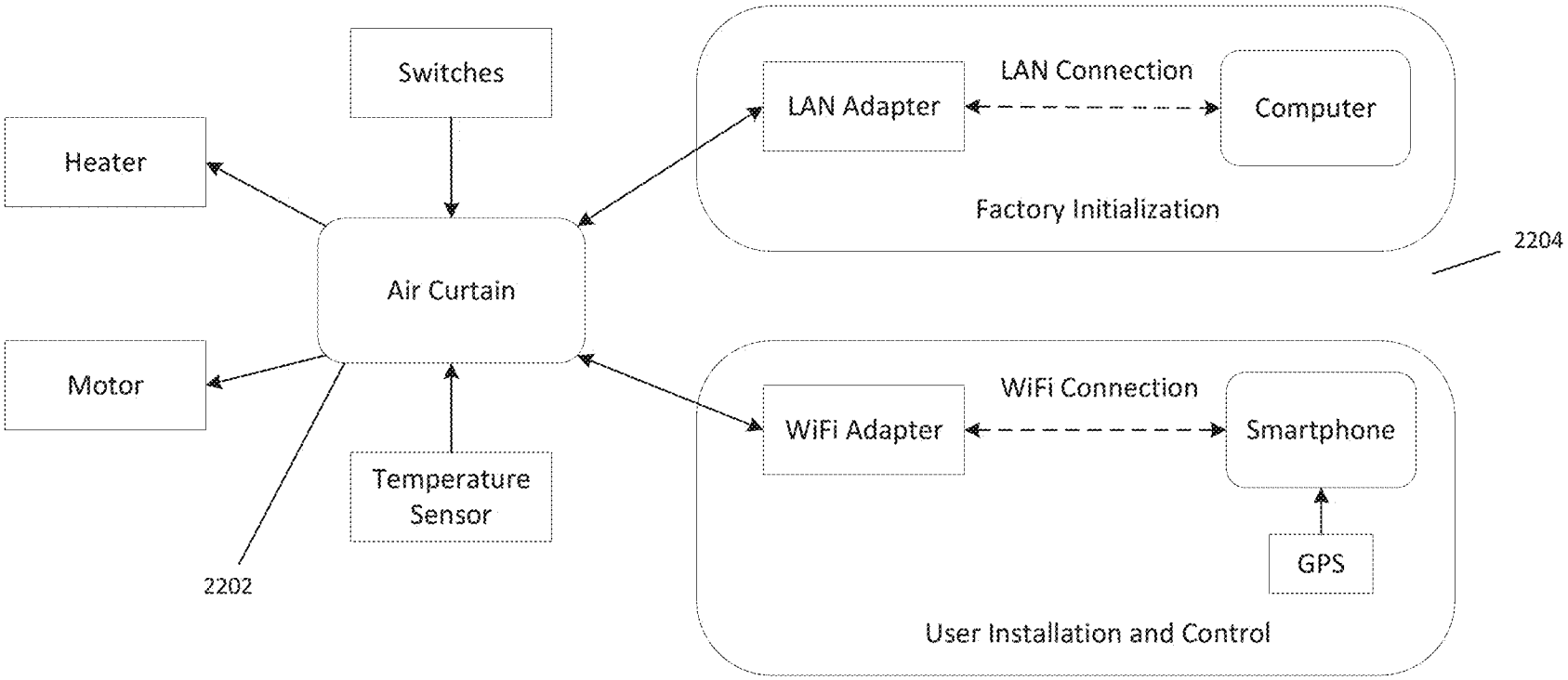
FIG. 22 includes one example of a system architecture structured in accordance with certain embodiments of the invention.
Figure 23:
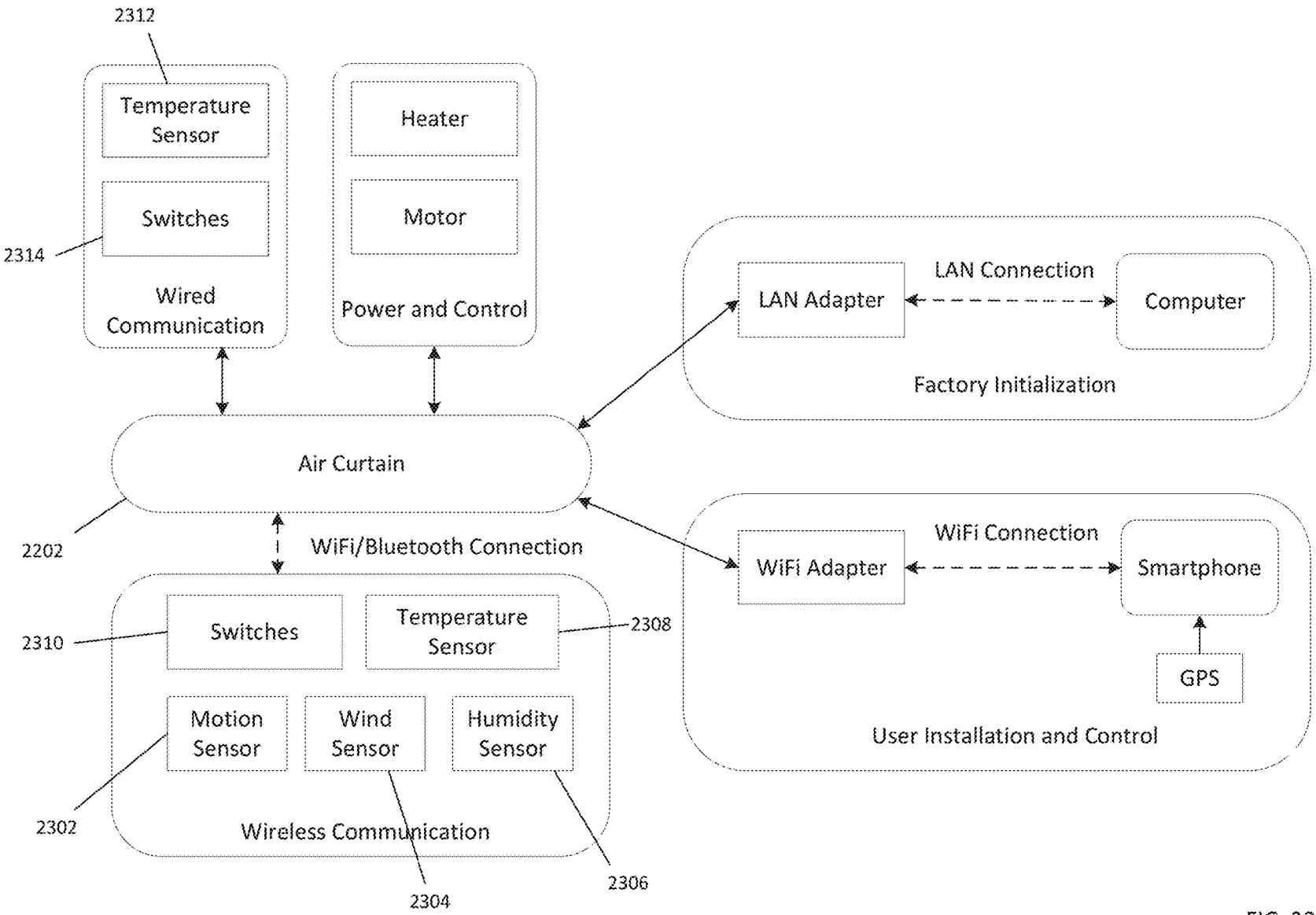
FIG. 23 includes one example of a system architecture structured in accordance with certain embodiments of the invention.
Figure 24:
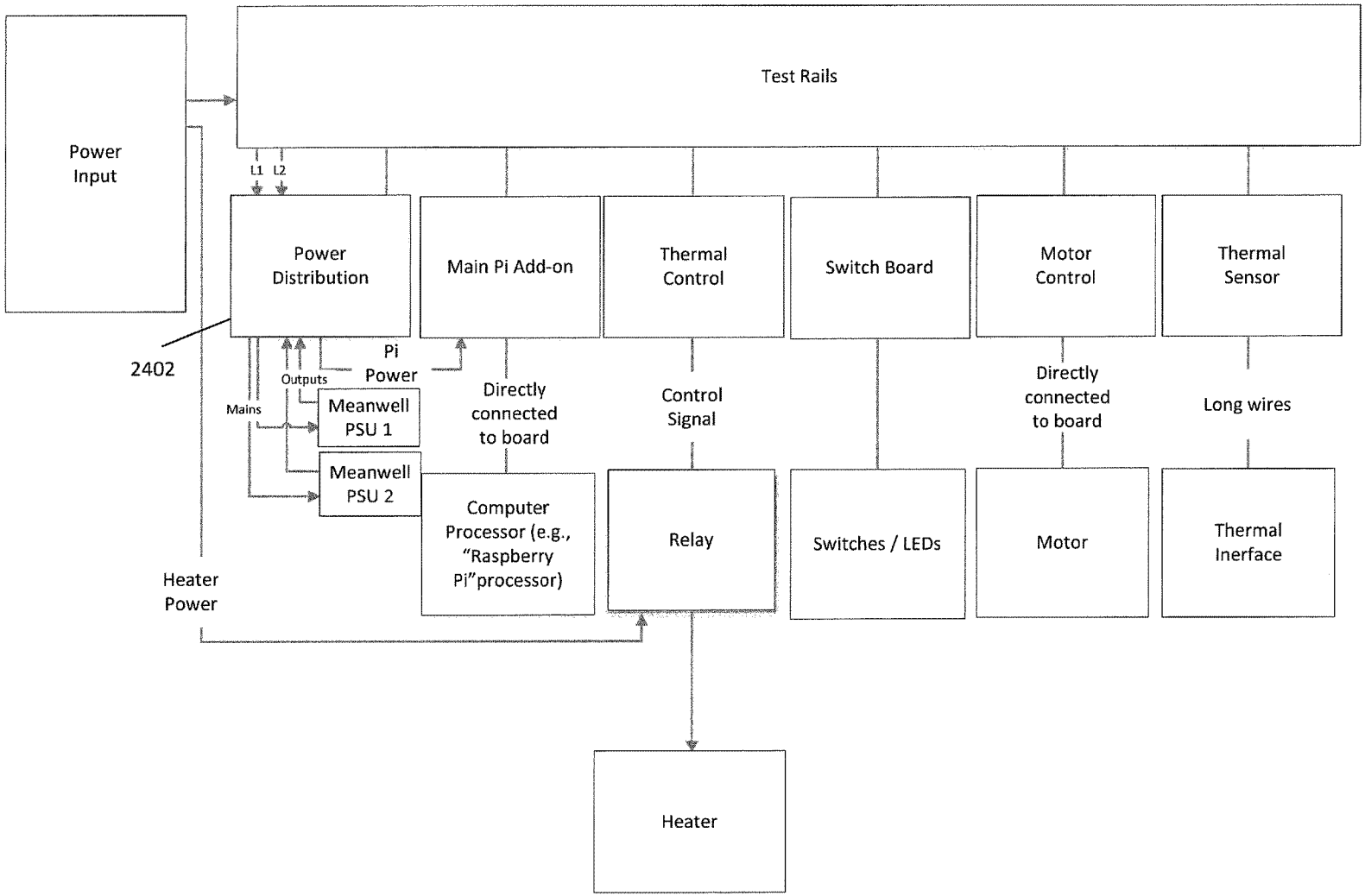
FIG. 24 includes one example of a system architecture structured in accordance with certain embodiments of the invention.

FIGS. 22-24 include examples of other architectures or systems which may employ certain embodiments of the tools and techniques described herein. FIG. 22 includes an example illustrating how initial settings for an air curtain device 2202 may be specified during the manufacturing process (e.g., at a factory 2204). FIG. 23 includes an example illustrating how certain components (e.g., sensors 2302, 2304, 2306, 2308 or switches 2310) can be configured for wireless communication with the device 2202; while other components (e.g., sensor 2312 and switches 2314) can be configured for wired communication with the device 2202.

FIG. 24 includes an example illustrating the interaction of various components of an air curtain device (such as the device 202) and how power can be supplied to various components. In this example, power can be supplied to the various components directly through terminal contact with a power distribution element 2402 or through a wire connector component, for example.

Figure 25:
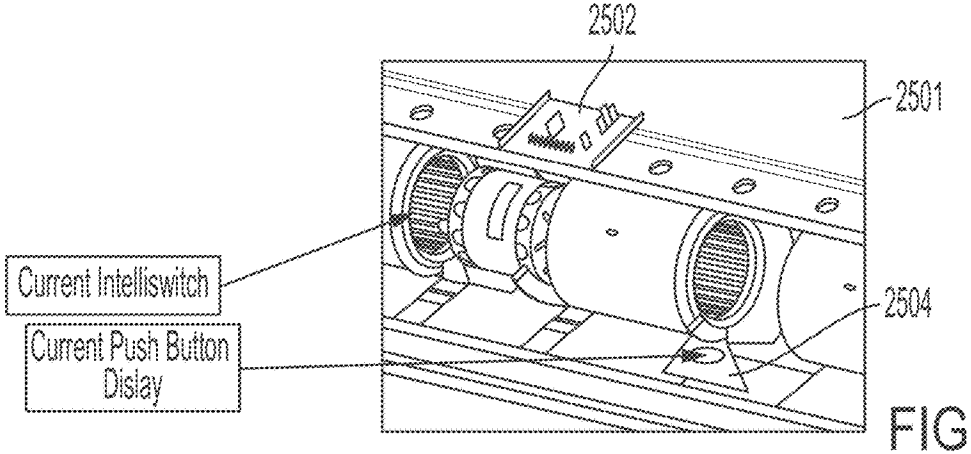
FIGS. 25 and 26 illustrate an example of a retrofit assembly process which can be provided in accordance with certain embodiments of the invention.
Figure 26:
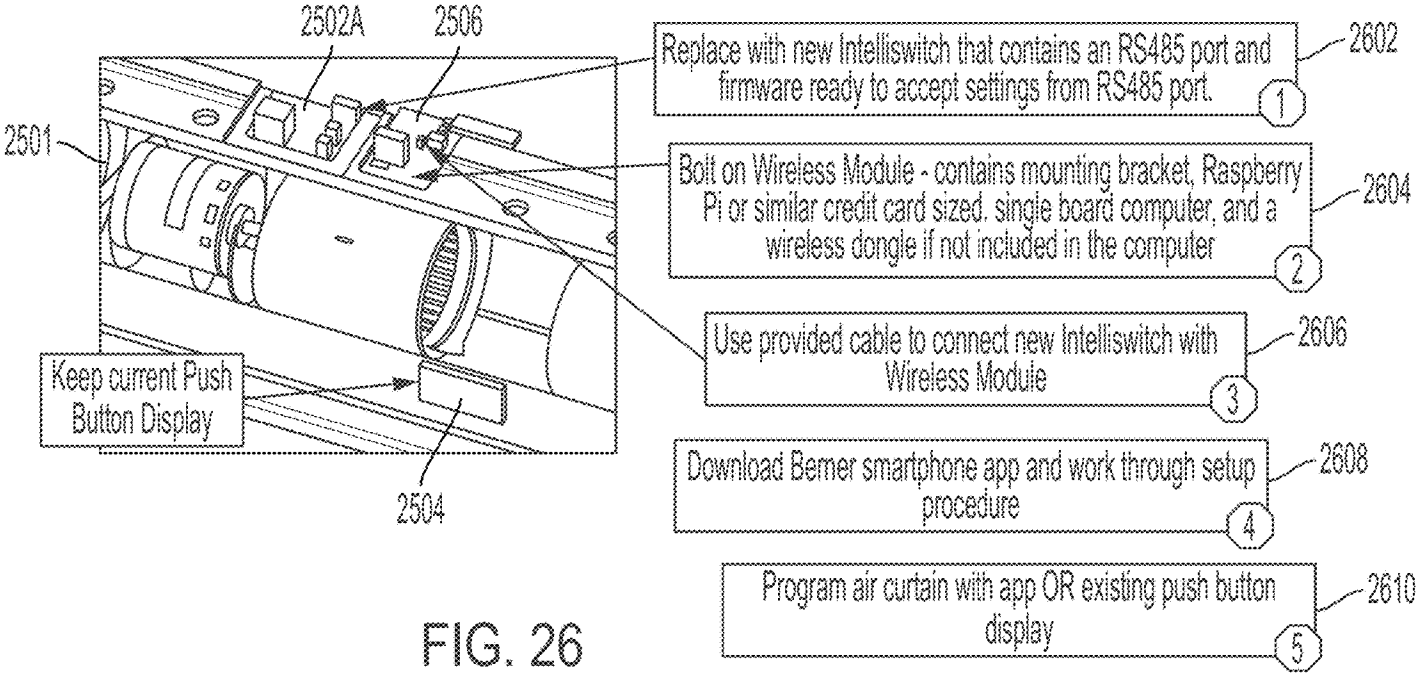

FIGS. 25 and 26 illustrate an example of a retrofit assembly process which can be provided in accordance with certain embodiments of the invention. FIG. 25 illustrates a configuration for an air curtain device 2501 prior to installation of components which enable use of the tools, techniques, and processes described herein in accordance with certain embodiments of the invention. As shown, the device 2501 includes a control element 2502 one embodiment of which may be the "Intelliswitch" control component (Berner International Corp.) for directing certain tasks and functions within the device 2502. In addition, the device 2501 may include a push button display 2504, such as for receiving manual commands from a user and for programming the functions to be performed by the control element 2502.

To retrofit the device 2501 for operation in accordance with certain embodiments of the invention, at step 2602 the control element 2502 may be replaced by a new control element 2502A modified to include a data communication port (e.g., an RS-485 port) and firmware programmed to receive data settings and parameters through the data communication port. At step 2604, a wireless module 2506 may be installed in the vicinity of the control element 2502A (as shown in FIG. 26). The wireless module 2506 may include various operative components, such as a motherboard computer processor programmed to perform various tasks and process data in accordance with various embodiments of the invention described hereinabove. The wireless module 2506 may also include a wireless dongle or other wireless receiver/transceiver component configured to provide communication capabilities with an access device 302, for example. At step 2606, the wireless module 2506 can be connected to the control element 2502A, such as by use of a cable or wire, to facilitate control of the tasks and functions of the control element 2502A by the wireless module 2506. At step 2608, a user may employ a suitable access device to configure settings or parameters for the device 2501 (as described above). In the alternative, at step 2610 the device 2501 may be programmed or adjusted through use of an access device, or the existing push button display 2504, or both.

Figure 28:
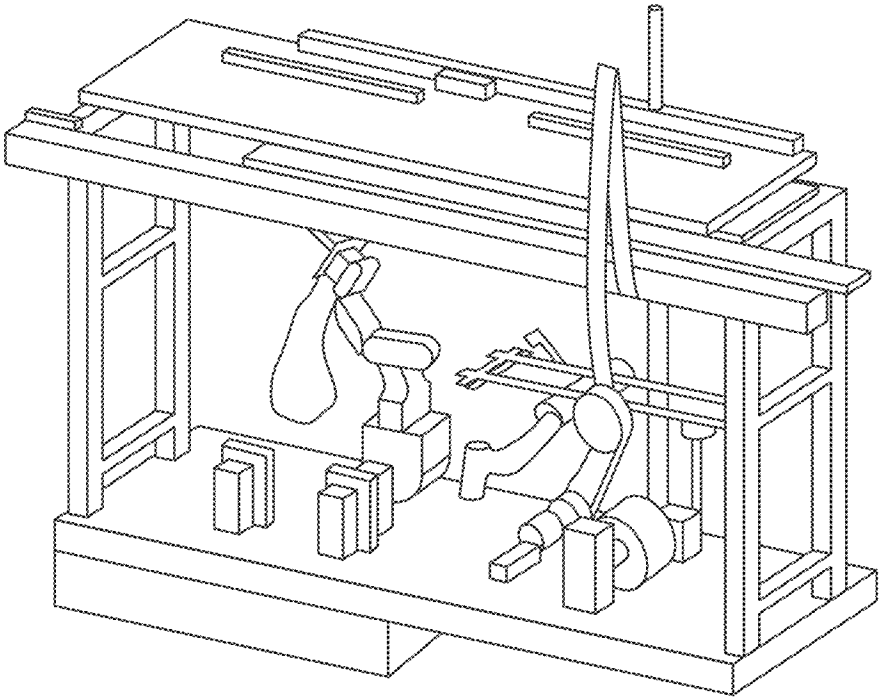
FIGS. 27 and 28 illustrate an example of a process for performing robotic assembly of certain aspects of an air curtain device; and, FIG. 29 includes an example of a report which can be generated in accordance with certain embodiments described herein.
Figure 27:
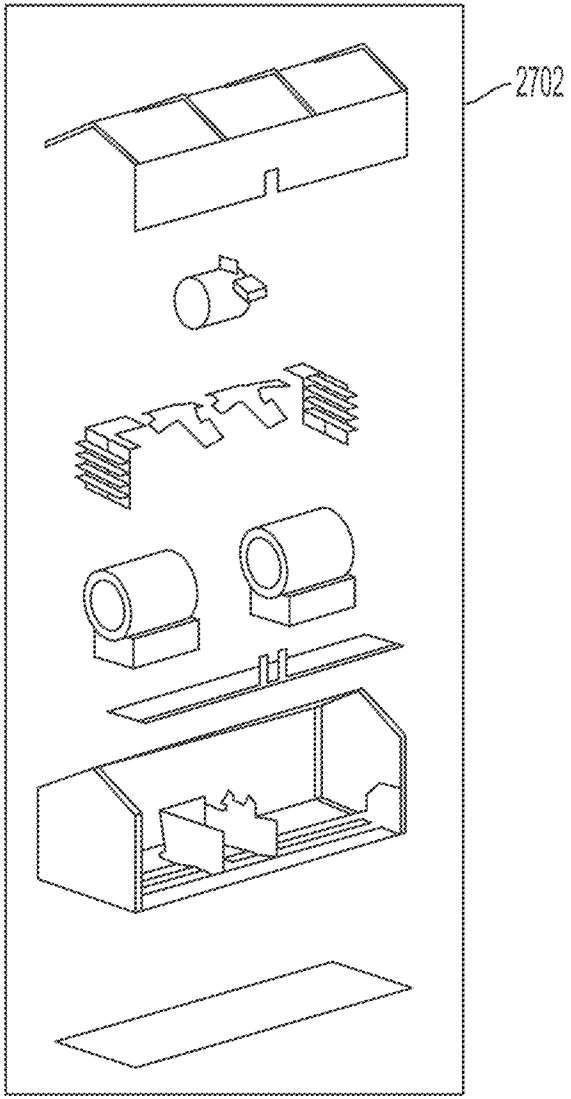

FIGS. 27 and 28 illustrate an example of a process for performing robotic assembly of certain aspects of an air curtain device. FIG. 27 includes an exploded view of the various components of an air curtain device 2702 as it may be configured to facilitate robotic assembly. FIG. 28 includes a schematic view of the robot assembly process of combining and assembling different components of the air curtain device 2702 with a robotic arm.

Figure 29:
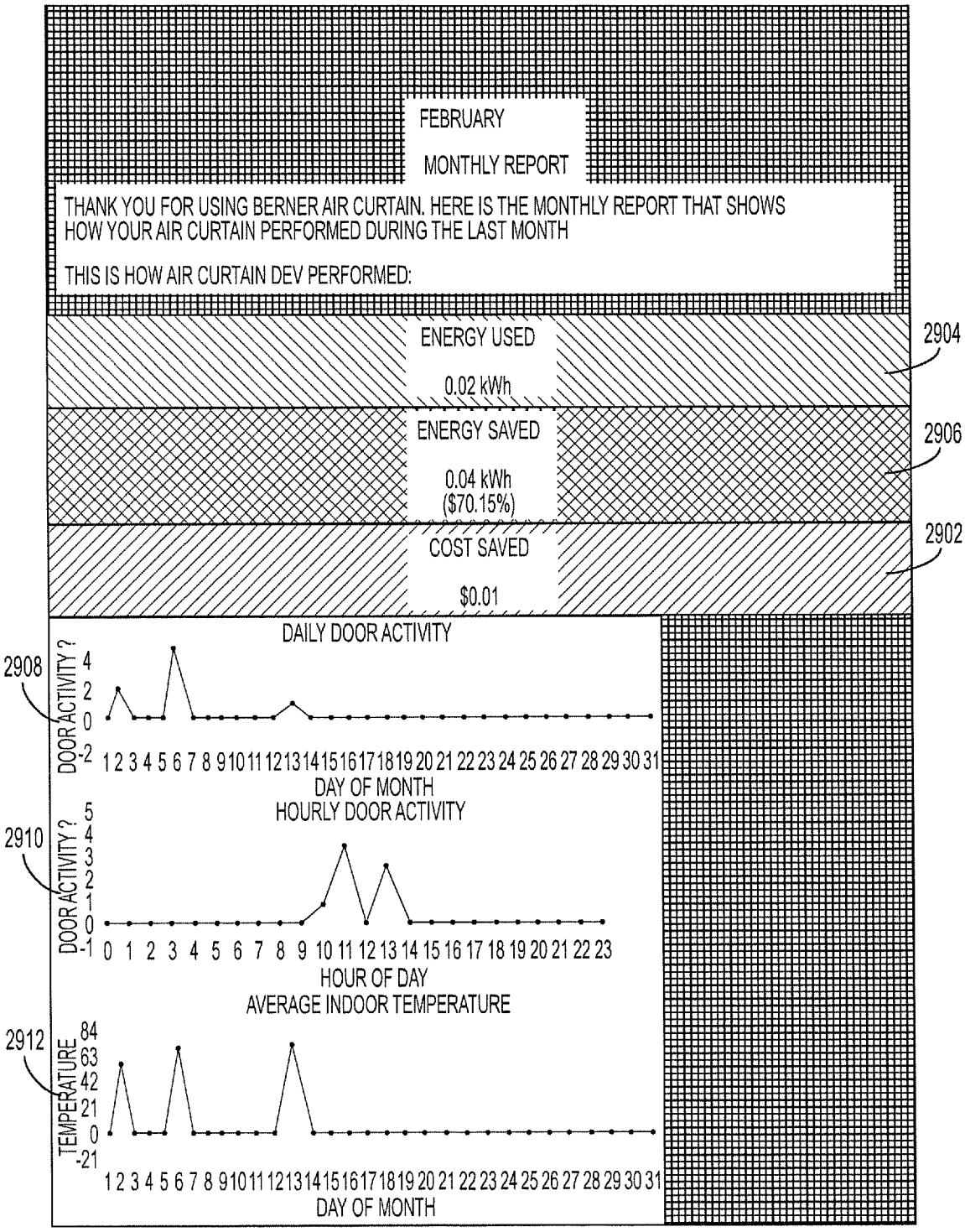

An example of a report which can be generated in accordance with certain embodiments described herein is shown in FIG. 29. As shown, cost savings 2902 can be calculated as a function of a comparison of energy used 2904 against energy saved 2906 as a result of using an air curtain device programmed in accordance with certain embodiments of the invention. In certain embodiments, the report may include graphical illustrations of daily door activity 2908, hourly door activity 2910, or average indoor temperature 2912, for example, among many other conditions or states which can be observed by operation of the air curtain device.

The examples presented herein are intended to illustrate potential and specific implementations of the present invention. It can be appreciated that the examples are intended primarily for purposes of illustration of the invention for those skilled in the art. No particular aspect or aspects of the examples are necessarily intended to limit the scope of the present invention. For example, no particular aspect or aspects of the examples of system architectures, user interface layouts, or screen displays described herein are necessarily intended to limit the scope of the invention.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that a sufficient understanding of the present invention can be gained by the present disclosure, and therefore, a more detailed description of such elements is not provided herein.

Any element expressed herein as a means for performing a specified function is intended to encompass any way of performing that function including, for example, a combination of elements that performs that function. Furthermore the invention, as may be defined by such means-plus-function claims, resides in the fact that the functionalities provided by the various recited means are combined and brought together in a manner as defined by the appended claims. Therefore, any means that can provide such functionalities may be considered equivalents to the means shown herein.

In various embodiments, modules or software can be used to practice certain aspects of the invention. For example, software-as-a-service (SaaS) models or application service provider (ASP) models may be employed as software application delivery models to communicate software applications to clients or other users. Such software applications can be downloaded through an Internet connection, for example, and operated either independently (e.g., downloaded to a laptop or desktop computer system) or through a third-party service provider (e.g., accessed through a third-party web site). In addition, cloud computing techniques may be employed in connection with various embodiments of the invention. In certain embodiments, a "module" may include software, firmware, hardware, or any reasonable combination thereof.

Moreover, the processes associated with the present embodiments may be executed by programmable equipment, such as computers. Software or other sets of instructions that may be employed to cause programmable equipment to execute the processes may be stored in any storage device, such as a computer system (non-volatile) memory. Furthermore, some of the processes may be programmed when the computer system is manufactured or via a computer-readable memory storage medium.

It can also be appreciated that certain process aspects described herein may be performed using instructions stored on a computer-readable memory medium or media that direct a computer or computer system to perform process steps. A computer-readable medium may include, for example, memory devices such as diskettes, compact discs of both read-only and read/write varieties, optical disk drives, and hard disk drives. A computer-readable medium may also include memory storage that may be physical, virtual, permanent, temporary, semi-permanent and/or semi-temporary. Memory and/or storage components may be implemented using any computer-readable media capable of storing data such as volatile or non-volatile memory, removable or non-removable memory, erasable or non-erasable memory, writeable or re-writeable memory, and so forth. Examples of computer-readable storage media may include, without limitation, RAM, dynamic RAM (DRAM), Double-Data-Rate DRAM (DDRAM), synchronous DRAM (SDRAM), static RAM (SRAM), read-only memory (ROM), programmable ROM (PROM), erasable programmable ROM (EPROM), electrically erasable programmable ROM (EEPROM), flash memory (e.g., NOR or NAND flash memory), content addressable memory (CAM), polymer memory (e.g., ferroelectric polymer memory), phase-change memory, ovonic memory, ferroelectric memory, silicon-oxide-nitride-oxide-silicon (SONOS) memory, magnetic or optical cards, or any other type of media suitable for storing information.

A "computer," "computer system," "computing apparatus," "component," or "computer processor" may be, for example and without limitation, a processor, microcomputer, minicomputer, server, mainframe, laptop, personal data assistant (PDA), wireless e-mail device, smart phone, mobile phone, electronic tablet, cellular phone, pager, processor, fax machine, scanner, or any other programmable device or computer apparatus configured to transmit, process, and/or receive data. Computer systems and computer-based devices disclosed herein may include memory and/or storage components for storing certain software applications used in obtaining, processing, and communicating information. It can be appreciated that such memory may be internal or external with respect to operation of the disclosed embodiments. In various embodiments, a "host," "engine," "loader," "filter," "platform," or "component" may include various computers or computer systems, or may include a reasonable combination of software, firmware, and/or hardware.

In various embodiments of the present invention, a single component may be replaced by multiple components, and multiple components may be replaced by a single component, to perform a given function or functions. Except where such substitution would not be operative to practice embodiments of the present invention, such substitution is within the scope of the present invention. Any of the servers described herein, for example, may be replaced by a "server farm" or other grouping of networked servers (e.g., a group of server blades) that are located and configured for cooperative functions. It can be appreciated that a server farm may serve to distribute workload between/among individual components of the farm and may expedite computing processes by harnessing the collective and cooperative power of multiple servers. Such server farms may employ load-balancing software that accomplishes tasks such as, for example, tracking demand for processing power from different machines, prioritizing and scheduling tasks based on network demand, and/or providing backup contingency in the event of component failure or reduction in operability.

In general, it will be apparent to one of ordinary skill in the art that various embodiments described herein, or components or parts thereof, may be implemented in many different embodiments of software, firmware, and/or hardware, or modules thereof. The software code or specialized control hardware used to implement some of the present embodiments is not limiting of the present invention. For example, the embodiments described hereinabove may be implemented in computer software using any suitable computer programming language such as .NET or HTML using, for example, conventional or object-oriented techniques. Programming languages for computer software and other computer-implemented instructions may be translated into machine language by a compiler or an assembler before execution and/or may be translated directly at run time by an interpreter. Examples of assembly languages include ARM, MIPS, and x86; examples of high level languages include Ada, BASIC, C, C++, C #, COBOL, Fortran, Java, Lisp, Pascal, Object Pascal; and examples of scripting languages include Bourne script, JavaScript, Python, Ruby, PHP, and Perl. Various embodiments may be employed in a Lotus Notes environment, for example. Such software may be stored on any type of suitable computer-readable medium or media such as, for example, a magnetic or optical storage medium. Thus, the operation and behavior of the embodiments are described without specific reference to the actual software code or specialized hardware components. The absence of such specific references is feasible because it is clearly understood that artisans of ordinary skill would be able to design software and control hardware to implement the embodiments of the present invention based on the description herein with only a reasonable effort and without undue experimentation.

Various embodiments of the systems and methods described herein may employ one or more electronic computer networks to promote communication among different components, transfer data, or to share resources and information. Such computer networks can be classified according to the hardware and software technology that is used to interconnect the devices in the network, such as optical fiber, Ethernet, wireless LAN, HomePNA, power line communication or G.hn. The computer networks may also be embodied as one or more of the following types of networks: local area network (LAN); metropolitan area network (MAN); wide area network (WAN); virtual private network (VPN); storage area network (SAN); or global area network (GAN), among other network varieties.

For example, a WAN computer network may cover a broad area by linking communications across metropolitan, regional, or national boundaries. The network may use routers and/or public communication links. One type of data communication network may cover a relatively broad geographic area (e.g., city-to-city or country-to-country) which uses transmission facilities provided by common carriers, such as telephone service providers. In another example, a GAN computer network may support mobile communications across multiple wireless LANs or satellite networks. In another example, a VPN computer network may include links between nodes carried by open connections or virtual circuits in another network (e.g., the Internet) instead of by physical wires. The link-layer protocols of the VPN can be tunneled through the other network. One VPN application can promote secure communications through the Internet. The VPN can also be used to separately and securely conduct the traffic of different user communities over an underlying network. The VPN may provide users with the virtual experience of accessing the network through an IP address location other than the actual IP address which connects the access device to the network.

The computer network may be characterized based on functional relationships among the elements or components of the network, such as active networking, client-server, or peer-to-peer functional architecture. The computer network may be classified according to network topology, such as bus network, star network, ring network, mesh network, star-bus network, or hierarchical topology network, for example. The computer network may also be classified based on the method employed for data communication, such as digital and analog networks.

Embodiments of the methods and systems described herein may employ internetworking for connecting two or more distinct electronic computer networks or network segments through a common routing technology. The type of internetwork employed may depend on administration and/or participation in the internetwork. Non-limiting examples of internetworks include intranet, extranet, and Internet. Intranets and extranets may or may not have connections to the Internet. If connected to the Internet, the intranet or extranet may be protected with appropriate authentication technology or other security measures. As applied herein, an intranet can be a group of networks which employ Internet Protocol, web browsers and/or file transfer applications, under common control by an administrative entity. Such an administrative entity could restrict access to the intranet to only authorized users, for example, or another internal network of an organization or commercial entity. As applied herein, an extranet may include a network or internetwork generally limited to a primary organization or entity, but which also has limited connections to the networks of one or more other trusted organizations or entities (e.g., customers of an entity may be given access an intranet of the entity thereby creating an extranet).

Computer networks may include hardware elements to interconnect network nodes, such as network interface cards (NICs) or Ethernet cards, repeaters, bridges, hubs, switches, routers, and other like components. Such elements may be physically wired for communication and/or data connections may be provided with microwave links (e.g., IEEE 802.12) or fiber optics, for example. A network card, network adapter or NIC can be designed to allow computers to communicate over the computer network by providing physical access to a network and an addressing system through the use of MAC addresses, for example. A repeater can be embodied as an electronic device that receives and retransmits a communicated signal at a boosted power level to allow the signal to cover a telecommunication distance with reduced degradation. A network bridge can be configured to connect multiple network segments at the data link layer of a computer network while learning which addresses can be reached through which specific ports of the network. In the network, the bridge may associate a port with an address and then send traffic for that address only to that port. In various embodiments, local bridges may be employed to directly connect local area networks (LANs); remote bridges can be used to create a wide area network (WAN) link between LANs; and/or, wireless bridges can be used to connect LANs and/or to connect remote stations to LANs.

In various embodiments, a hub may be employed which contains multiple ports. For example, when a data packet arrives at one port of a hub, the packet can be copied unmodified to all ports of the hub for transmission. A network switch or other devices that forward and filter OSI layer 2 datagrams between ports based on MAC addresses in data packets can also be used. A switch can possess multiple ports, such that most of the network is connected directly to the switch, or another switch that is in turn connected to a switch. The term "switch" can also include routers and bridges, as well as other devices that distribute data traffic by application content (e.g., a Web URL identifier). Switches may operate at one or more OSI model layers, including physical, data link, network, or transport (i.e., end-to-end). A device that operates simultaneously at more than one of these layers can be considered a multilayer switch. In certain embodiments, routers or other like networking devices may be used to forward data packets between networks using headers and forwarding tables to determine an optimum path through which to transmit the packets.

As employed herein, an application server may be a server that hosts an API to expose business logic and business processes for use by other applications. Examples of application servers include J2EE or Java EE 5 application servers including WebSphere Application Server. Other examples include WebSphere Application Server Community Edition (IBM), Sybase Enterprise Application Server (Sybase Inc), WebLogic Server (BEA), JBoss (Red Hat), JRun (Adobe Systems), Apache Geronimo (Apache Software Foundation), Oracle OC4J (Oracle Corporation), Sun Java System Application Server (Sun Microsystems), and SAP Netweaver AS (ABAP/Java). Also, application servers may be provided in accordance with the .NET framework, including the Windows Communication Foundation, .NET Remoting, ADO.NET, and ASP.NET among several other components. For example, a Java Server Page (JSP) is a servlet that executes in a web container which is functionally equivalent to CGI scripts. JSPs can be used to create HTML pages by embedding references to the server logic within the page. The application servers may mainly serve web-based applications, while other servers can perform as session initiation protocol servers, for instance, or work with telephony networks. Specifications for enterprise application integration and service-oriented architecture can be designed to connect many different computer network elements. Such specifications include Business Application Programming Interface, Web Services Interoperability, and Java EE Connector Architecture.

Embodiments of the methods and systems described herein may divide functions between separate CPUs, creating a multiprocessing configuration. For example, multiprocessor and multi-core (multiple CPUs on a single integrated circuit) computer systems with co-processing capabilities may be employed. Also, multitasking may be employed as a computer processing technique to handle simultaneous execution of multiple computer programs.

In various embodiments, the computer systems, data storage media, or modules described herein may be configured and/or programmed to include one or more of the above-described electronic, computer-based elements and components, or computer architecture. In addition, these elements and components may be particularly configured to execute the various rules, algorithms, programs, processes, and method steps described herein.

Various embodiments may be described herein in the general context of computer executable instructions, such as software, program modules, and/or engines being executed by a computer. Generally, software, program modules, and/or engines include any software element arranged to perform particular operations or implement particular abstract data types. Software, program modules, and/or engines can include routines, programs, objects, components, data structures and the like that perform particular tasks or implement particular abstract data types. An implementation of the software, program modules, and/or engines components and techniques may be stored on and/or transmitted across some form of computer-readable media. In this regard, computer-readable media can be any available medium or media useable to store information and accessible by a computing device. Some embodiments also may be practiced in distributed computing environments where operations are performed by one or more remote processing devices that are linked through a communications network. In a distributed computing environment, software, program modules, and/or engines may be located in both local and remote computer storage media including memory storage devices.

Although some embodiments may be illustrated and described as comprising functional components, software, engines, and/or modules performing various operations, it can be appreciated that such components or modules may be implemented by one or more hardware components, software components, and/or combination thereof. The functional components, software, engines, and/or modules may be implemented, for example, by logic (e.g., instructions, data, and/or code) to be executed by a logic device (e.g., processor). Such logic may be stored internally or externally to a logic device on one or more types of computer-readable storage media. In other embodiments, the functional components such as software, engines, and/or modules may be implemented by hardware elements that may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Examples of software, engines, and/or modules may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

In some cases, various embodiments may be implemented as an article of manufacture. The article of manufacture may include a computer readable storage medium arranged to store logic, instructions and/or data for performing various operations of one or more embodiments. In various embodiments, for example, the article of manufacture may comprise a magnetic disk, optical disk, flash memory or firmware containing computer program instructions suitable for execution by a general purpose processor or application specific processor. The embodiments, however, are not limited in this context.

Additionally, it is to be appreciated that the embodiments described herein illustrate example implementations, and that the functional elements, logical blocks, modules, and circuits elements may be implemented in various other ways which are consistent with the described embodiments. Furthermore, the operations performed by such functional elements, logical blocks, modules, and circuits elements may be combined and/or separated for a given implementation and may be performed by a greater number or fewer number of components or modules. As will be apparent to those of skill in the art upon reading the present disclosure, each of the individual embodiments described and illustrated herein has discrete components and features which may be readily separated from or combined with the features of any of the other several aspects without departing from the scope of the present disclosure. Any recited method can be carried out in the order of events recited or in any other order which is logically possible.

Reference to "one embodiment" or "an embodiment" means that a particular feature, structure, or characteristic described in connection with the embodiment is comprised in at least one embodiment. The appearances of the phrase "in one embodiment" or "in one aspect" in the specification are not necessarily all referring to the same embodiment.

Unless specifically stated otherwise, it may be appreciated that terms such as "processing," "computing," "calculating," "determining," or the like, refer to the action and/or processes of a computer or computing system, or similar electronic computing device, such as a general purpose processor, a DSP, ASIC, FPGA or other programmable logic device, discrete gate or transistor logic, discrete hardware components, or any combination thereof designed to perform the functions described herein that manipulates and/or transforms data represented as physical quantities (e.g., electronic) within registers and/or memories into other data similarly represented as physical quantities within the memories, registers or other such information storage, transmission or display devices.

Certain embodiments may be described using the expression "coupled" and "connected" along with their derivatives. These terms are not necessarily intended as synonyms for each other. For example, some embodiments may be described using the terms "connected" and/or "coupled" to indicate that two or more elements are in direct physical or electrical contact with each other. The term "coupled," however, also may mean that two or more elements are not in direct contact with each other, but yet still co-operate or interact with each other. With respect to software elements, for example, the term "coupled" may refer to interfaces, message interfaces, application program interface (API), exchanging messages, and so forth.

It will be appreciated that those skilled in the art will be able to devise various arrangements which, although not explicitly described or shown herein, embody the principles of the present disclosure and are comprised within the scope thereof. Furthermore, all examples and conditional language recited herein are principally intended to aid the reader in understanding the principles described in the present disclosure and the concepts contributed to furthering the art, and are to be construed as being without limitation to such specifically recited examples and conditions. Moreover, all statements herein reciting principles, aspects, and embodiments as well as specific examples thereof, are intended to encompass both structural and functional equivalents thereof. Additionally, it is intended that such equivalents comprise both currently known equivalents and equivalents developed in the future, i.e., any elements developed that perform the same function, regardless of structure. The scope of the present disclosure, therefore, is not intended to be limited to the exemplary aspects and aspects shown and described herein.

The various processes and techniques described herein may be implemented at least in part by software, comprising instructions that are stored or maintained by the computer-readable memory of the access device, the host computing device, and/or of any other device, or by independent computer-readable memory that is used for storing and transferring the software.

Although various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those of ordinary skill in the art and, consequently, are not described in detail herein.

The flow charts and methods described herein show the functionality and operation of various implementations. If embodied in software, each block, step, or action may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processing component in a computer system. If embodied in hardware, each block may represent a circuit or a number of interconnected circuits to implement the specified logical function(s).

Although the flow charts and methods described herein may describe a specific order of execution, it is understood that the order of execution may differ from that which is described. For example, the order of execution of two or more blocks or steps may be scrambled relative to the order described. Also, two or more blocks or steps may be executed concurrently or with partial concurrence. Further, in some embodiments, one or more of the blocks or steps may be skipped or omitted. It is understood that all such variations are within the scope of the present disclosure.

The terms "a" and "an" and "the" and similar referents used in the context of the present disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as when it were individually recited herein. All methods described herein can be performed in any suitable order unless otherwise indicated herein or otherwise clearly contradicted by context. The use of any and all examples, or exemplary language (e.g., "such as," "in the case," "by way of example") provided herein is intended merely to better illuminate the disclosed embodiments and does not pose a limitation on the scope otherwise claimed. No language in the specification should be construed as indicating any non-claimed element essential to the practice of the claimed subject matter. It is further noted that the claims may be drafted to exclude any optional element. As such, this statement is intended to serve as antecedent basis for use of such exclusive terminology as solely, only and the like in connection with the recitation of claim elements, or use of a negative limitation.

Groupings of alternative elements or embodiments disclosed herein are not to be construed as limitations. Each group member may be referred to and claimed individually or in any combination with other members of the group or other elements found herein. It is anticipated that one or more members of a group may be comprised in, or deleted from, a group for reasons of convenience and/or patentability.

While various embodiments of the invention have been described herein, it should be apparent, however, that various modifications, alterations and adaptations to those embodiments may occur to persons skilled in the art with the attainment of some or all of the advantages of the present invention. The disclosed embodiments are therefore intended to include all such modifications, alterations and adaptations without departing from the scope and spirit of the present invention as described and claimed herein.

What is claimed is:

1. A method for operating an air curtain device, the method comprising:

installing an air curtain device in a location associated with a door positioned between at least one interior space located within a facility and at least one exterior space located in an environment external to the facility, wherein the interior space and the exterior space are in air flow communication when the door is open;

receiving, in a wireless mesh computer architecture comprising at least one control server operatively associated with the air curtain device, input data from at least one external data source comprising weather related data;

receiving, by the control server, input data from at least one external data source comprising current energy price data or future energy price data;

applying an algorithm module to determine an adjusted operating parameter for the air curtain device in response to the input data received from the external data sources, wherein the adjusted parameter is determined in response to a number of door cycles for a door operatively associated with the air curtain device; and communicating the adjusted operating parameter to at least one component of the air curtain device in association with implementing the adjusted parameter, wherein implementing the adjusted parameter includes at least:

adjusting at least a motor speed of the air curtain device in response to the communicated adjusted parameter; and, adjusting at least one directional vane of a blower of the air curtain device in response to the communicated adjusted parameter.

2. The method of claim 1, further comprising receiving input data from at least a second air curtain device.

3. The method of claim 2, further comprising receiving input data from at least one sensor commonly associated with the first and second air curtain devices.

4. The method of claim 3, further comprising applying the algorithm module in response to receiving the commonly associated sensor input data.

5. The method of claim 2, further comprising communicating at least one adjusted parameter to at least the second air curtain device.

6. The method of claim 1, further comprising:

receiving input data from at least one wind sensor operatively associated with the air curtain device, wherein the wind sensor is configured to communicate a signal indicative of wind velocity in at least a portion of the external environment in the vicinity of the air curtain device.

7. The method of claim 1, further comprising determining at least one adjusted parameter in response to ambient background noise associated with a location of the air curtain device.

8. The method of claim 1, further comprising adjusting an amount of heat supplied by the air curtain device in response to the communicated adjusted parameter.

9. The method of claim 1, further comprising communicating the adjusted parameter in association with initiating a destratification mode of the air curtain device.

10. The method of claim 1, further comprising communicating at least one alert or notification in response to the communicated adjusted parameter.

11. The method of claim 1, further comprising receiving input data from at least one people meter programmed for estimating a number of people in a vicinity of the air curtain device.

12. The method of claim 11, further comprising predicting an amount of heat in a facility in association with associated with the people meter input data.

13. The method of claim 12, further comprising adjusting an amount of heat supplied by the air curtain device in response to the predicted amount of heat.

14. An air curtain system comprising:

an air curtain device installed in a location associated with a door positioned between at least one interior space located within a facility and at least one exterior space located in an environment external to the facility, wherein the interior space and the exterior space are in air flow communication when the door is open; and, a wireless mesh computer architecture comprising at least one control server operatively associated with the air curtain device, the control server programmed for:

receiving input data from at least one external data source comprising weather related data, receiving input data from at least one external data source comprising current energy price data or future energy price data, applying an algorithm module to determine an adjusted operating parameter for the air curtain device in response to the input data received from the external data sources, wherein the adjusted parameter is determined in response to a number of door cycles for a door operatively associated with the air curtain device; and communicating the adjusted operating parameter to at least one component of the air curtain device in association with implementing the adjusted parameter, wherein implementing the adjusted parameter includes at least:

adjusting at least a motor speed of the air curtain device in response to the communicated adjusted parameter, and, adjusting at least one directional vane of a blower of the air curtain device in response to the communicated adjusted parameter.

* * * * *